US009227112B2

(12) United States Patent
Kodama et al.

(10) Patent No.: US 9,227,112 B2
(45) **Date of Patent: *Jan. 5, 2016**

(54) BALL AND ENTERTAINMENT SYSTEM

(71) Applicant: Sachiko Muromura, Tokyo (JP)

(72) Inventors: Sachiko Kodama, Chofu (JP); Osamu Izuta, Tokyo (JP); Hideki Koike, Tokyo (JP)

(73) Assignee: Sachiko Muromura, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/488,340

(22) Filed: Sep. 17, 2014

(65) Prior Publication Data

US 2015/0133024 A1 May 14, 2015

Related U.S. Application Data

(63) Continuation of application No. 13/057,850, filed as application No. PCT/JP2009/062324 on Jul. 6, 2009, now Pat. No. 8,864,609.

(60) Provisional application No. 61/087,227, filed on Aug. 8, 2008.

(30) Foreign Application Priority Data

Oct. 27, 2008 (JP) ..... 2008-275984

(51) Int. Cl.
*A63B 43/00* (2006.01)
*A63B 43/06* (2006.01)

(52) U.S. Cl.
CPC ..... *A63B 43/06* (2013.01); *A63B 43/00* (2013.01); *A63B 2220/40* (2013.01); *A63B 2220/808* (2013.01); *A63B 2220/833* (2013.01)

(58) Field of Classification Search
CPC ..... A63B 2220/40; A63B 2220/833; A63B 2220/80; A63B 2220/808; A63B 43/00; A63B 43/06
USPC ..... 473/570
See application file for complete search history.

(56) References Cited

U.S. PATENT DOCUMENTS 2,020,484 A * 11/1935 Turner ..... 473/570
4,008,893 A 2/1977 Yoseloff (Continued)

FOREIGN PATENT DOCUMENTS

GB 2 213 069 8/1989
JP 2 57275 2/1990

(Continued)

OTHER PUBLICATIONS

International Preliminary Report on Patentability (English translation).

(Continued)

*Primary Examiner* — Michael Cuff
(74) *Attorney, Agent, or Firm* — Frommer Lawrence & Haug LLP; William S. Frommer

(57) ABSTRACT

Implementation including an outputter (11) following a control to output a signal, a microphone (10) for acquisition of sound from inside a ball (1*a*), a determiner (121) working in accordance with a level of sound acquired through the microphone (10) to determine a state of the ball (1*a*), and a control processor (122) working in accordance with a result of determination at the determiner (121) to generate a signal to output through the outputter (11).

16 Claims, 15 Drawing Sheets

(56) References Cited

U.S. PATENT DOCUMENTS

| | | | |
|---|---|---|---|
| 4,577,865 | A | 3/1986 | Shishido |
| 5,375,839 | A | 12/1994 | Pagani |
| 5,445,375 | A | 8/1995 | Sweeny |
| 5,526,326 | A | 6/1996 | Fekete et al. |
| 5,779,576 | A | 7/1998 | Smith et al. |
| 5,810,685 | A | 9/1998 | Willner et al. |
| 5,846,139 | A | 12/1998 | Bair et al. |
| 6,254,485 | B1 | 7/2001 | Kanagawa et al. |
| 6,578,527 | B1 | 6/2003 | Mathers |
| 7,219,891 | B2 | 5/2007 | Giegerich et al. |
| 7,733,416 | B2 | 6/2010 | Gal |
| 8,259,092 | B2 | 9/2012 | Lee et al. |
| 2001/0020935 | A1 | 9/2001 | Gelbman |
| 2002/0082124 | A1 | 6/2002 | Orner |
| 2002/0188359 | A1 | 12/2002 | Morse |
| 2003/0109338 | A1 | 6/2003 | Oister et al. |
| 2003/0153387 | A1 | 8/2003 | Small et al. |
| 2003/0190958 | A1 | 10/2003 | Paulsen |
| 2004/0236439 | A1 | 11/2004 | Hoffmann et al. |
| 2007/0032318 | A1 | 2/2007 | Nishimura et al. |
| 2008/0283311 | A1 | 11/2008 | Li |
| 2009/0210078 | A1 | 8/2009 | Crowley |

FOREIGN PATENT DOCUMENTS

| | | |
|---|---|---|
| JP | 2005 152619 | 6/2005 |
| JP | 2007 14671 | 1/2007 |
| JP | 2007 38001 | 2/2007 |

OTHER PUBLICATIONS

Japanese Office Action dated May 14, 2013.

Osamu Ida, "Sekigai Oyobi Full Color LED to Kasokudo Sensor o Naizo shita Sport-yo Gomu Ball 'Ham Boshi' no Kaihatsu", Interaction Ronbunshu, Information Processing Society of Japan, Mar. 2008.

Osamu Ida, "Hane Boshi; Denshi Kiki o Kumikonda Digital Sport-yo Gomu Ball no Kaihatsu", Wiss 2008 Yokoshu, Nov. 26, 2008, http://www.wiss.org/WISS2008Proceedings/papers/paper0021.pdf.

Office Action issued in corresponding Japanese application No. 2010-523807 dated Aug. 13, 2013 and the English translation.

* cited by examiner (a)

(b)

BALL AND ENTERTAINMENT SYSTEM

This is a continuation of application Ser. No. 13/057,850, filed Feb. 7, 2011, which is a 371 of PCT application serial number PCT/JP2009/062324, filed Jun. 6, 2009; which is entitled to the priority filing date of U.S. provisional application Ser. No. 61/087,227, filed Aug. 8, 2008, and to Japanese application number 2008-275984, filed Oct. 27, 2008, the entirety of which is incorporated herein by reference.

TECHNICAL FIELD

The present invention relates to a ball adapted to output a signal in accordance with a state of motion, and an entertainment system including the ball.

BACKGROUND ART

The ball has been a familiar play tool since ever, while there have been balls developed in recent years with various electronics incorporated therein to provide new functions. For instance, there has been use of a light emitting element set, such as an LED (light-emitting diode) set, incorporated in a ball to enable emission of light from the ball.

There has been disclosure of a ball adapted to count shocks thereto, to operate depending on the number of counts, to change emitting light in color, for satisfaction in degree of attainment in a monotonous exercise, such as an exercise of juggling a soccer ball (refer to Patent Literature 1, for instance).

Also, there has been disclosure of a ball adapted to emit light upon reception of shock, allowing for an enhanced interest in a play (refer to Patent Literature 2, for instance).

CITATION LIST

Patent Literature

PTL 1: Japanese Patent Application Laying-Open Publication No. 2004-16451

PTL 2: Japanese Registered Utility Model Publication No. 3058122

SUMMARY OF INVENTION

Technical Problem

As described, there has been adaptation for emission of light from a light emitting element set in a ball in a game, affording for use of the ball even in a dark place, or allowing for an enhanced interest in an exercise or game.

Such being the case, light emitting balls can entertain the users, while there might well be a ball adapted to operate depending on the state (motion), to change the way how to output a signal such as light or sound at or in the ball or usage environment of the ball, permitting the degree of satisfaction of user to be still enhanced.

With this point in view, the present invention provides a ball adapted to operate in accordance with a state thereof to change a signal to be output, or the method of outputting a signal, such as light or sound, at or in the ball or usage environment of the ball, affording to entertain the user or users, and an entertainment system using the ball.

Solution to Problem

According to an aspect of the present invention, there is a ball including an outputter adapted to follow a control to output signals, the ball comprising a microphone configured for acquisition of sound from inside the ball, a determiner configured to work in accordance with a sound acquired through the microphone, to determine a state of the ball, and a control processor configured to work in accordance with a result of determination at the determiner, to generate a signal to output through the outputter.

According to an aspect of the present invention, there is an entertainment system including a ball with an outputter adapted to output signals, and a control device adapted for control of signal output at the ball, wherein the ball comprises a microphone configured for acquisition of sound from inside the ball, a first communicator configured to transmit a sound acquired through the microphone to the control device, and receive signals transmitted from the control device, and a control processor configured to work in accordance with a signal received from the control device, to change a signal to output through the outputter, and the control device comprises a second communicator configured to receive a sound, and work in accordance with this sound, to transmit a signal to control the outputter, a determiner configured to work in accordance with a level of sound received at the second communicator; to determine a state of the ball, and a generator configured to work in accordance with a result of determination at the determiner, to generate a signal for control of the outputter, to output to the second communicator.

Advantageous Effects of Invention

According to the present invention, there is a ball adapted to operate in accordance with a state thereof, to change a signal to be output, or the method of outputting a signal, such as light or sound, at or in the ball or usage environment of the ball, allowing for an enhanced degree of satisfaction of the user or users.

DESCRIPTION OF EMBODIMENTS

First Embodiment

There will be described a ball according to a first embodiment of the present invention, with reference to associated drawings. According to the first embodiment of the present invention, there is a ball adapted for use in a game such as a sport, like a ball in the past, while being provided with a set of light emitting elements incorporated therein, for adaptation to operate in accordance with a motion it has when thrown, caused to roll, etc., to change among others emission colors or luminosities of light emitting elements.

Figure 1:
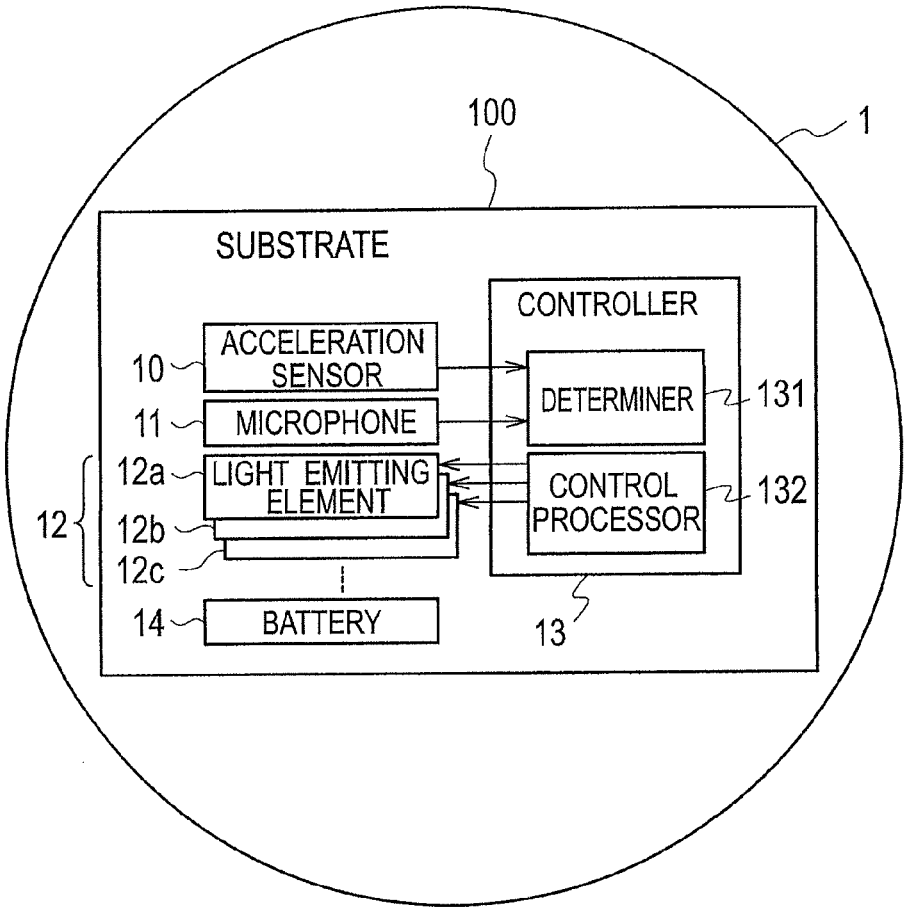
FIG. 1 is a schematic diagram of a ball according to a first embodiment of the present invention.

Referring to FIG. 1, according to the first embodiment of the present invention, there is a ball 1 having incorporated therein an acceleration sensor 10 configured to detect accelerations developed with motions, a microphone 11 configured to pick up sounds from inside the ball 1, a set of light emitting elements 12*a* to 12*c* each configured for emission of light over certain colors, a controller 13 configured to work in accordance with a level of acceleration detected at the acceleration sensor 10 and a level of sound acquired through the microphone 11 to change colors of light to emit at light emitting elements 12*a* to 12*c*, and a battery 14.

The acceleration sensor 10 is configured for detection of motion in a system of three axial directions (x-axis direction, y-axis direction, and z-axis direction) to output detected accelerations to the controller 13. The acceleration sensor 10 is adapted to separately output the axial component-wise accelerations to the controller 13.

The microphone 11 is configured for acquisition of sound from inside the ball 1 to output acquired sounds to the controller 13. There may be sounds acquired through the microphone 11, for use as data to discriminate a state of ball colliding with something such as an object (as a state given a shock) from other states, for instance. In this respect, at the microphone 11, any sound acquired is acquired as a data affording to grasp a level of sound.

The light emitting element 12*a* is configured to emit light, ranging a plurality of colors, and adapted to work under control from the controller 13 to change the emission color and the luminance. The light emitting element 12*a* is adapted to work under control from the controller 13 to blink on and off, affording to adjust the rate of blinking. The light emitting element 12*a* may be a full-color light-emitting diode adapted for instance to adjust luminosities of three primary colors of light being red, green, and blue, to change the emission color. FIG. 1 shows the ball 1 as an example provided with a set of three light emitting elements 12*a* to 12*c*, in which the light emitting element 12*b* as well as 12*c* has an identical configuration to the light emitting element 12*a*, to work under control from the controller 13 for emission of light. For the ball 1, the number of elements in the light emitting element set incorporated therein is not limited to three, and may well be an arbitrary plurality as necessary for emission of light in directions about the ball 1.

The controller 13, a miniature device such as a microcomputer, has stored therein a program configured to work in accordance with an acceleration or accelerations input from the acceleration sensor 10 and a sound or sounds input from the microphone 11, to control the light emitting element set 12 (12*a* to 12*c*) for emission of light. The controller 13 is adapted to execute the program to implement a determiner 131 configured to work in accordance with a level of acceleration and a level of sound input thereto to determine a state of the ball 1, and a control processor 132 configured to work in accordance with a state as determined at the determiner 131 to control the light emitting element set 12. Here, the controller 13 configured to receive axial component-wise accelerations separately input from the acceleration sensor 10 may be adapted under the program to process the axial accelerations to synthesize for use, or to use without synthesis.

The battery 14 is used for operation of the acceleration sensor 10, microphone 11, light emitting element set 12, and controller 13. It is noted that there are non-depicted power supply lines extending from the battery 14 to those components 10 to 13. The battery 14 may well be a rechargeable cell (as an electric accumulator or secondary cell) to be charged for storage of electricity. Assuming the battery to be a rechargeable cell, this may be charged by among others a charging method of connecting a plug to the ball 1 or a charging method of using a contact system. The battery 14 used may be a typical rechargeable battery, or besides, among others, a solar cell (photovoltaic cell) making use of light to cause a photovoltaic effect for storage of power, or a vibratory generator element making use of vibrations to generate electricity.

Figure 2:
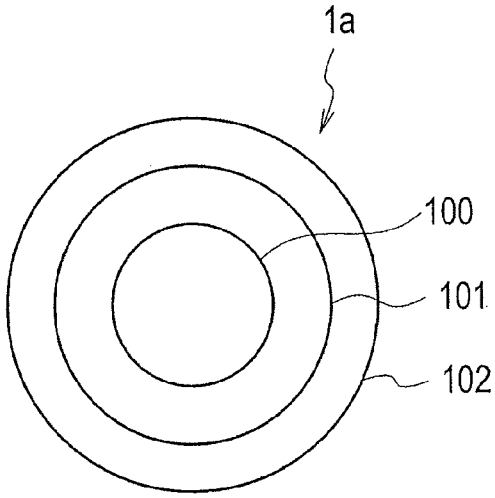
FIG. 2 is an explanatory schematic diagram of a layer structure of the ball shown in FIG. 1.

For the ball 1, those components (acceleration sensor 10, microphone 11, light emitting element set 12, controller 13, and battery 14) are mounted on a substrate 100, and incorporated together in the ball 1. The substrate 100 may well be configured to accommodate in the ball 1 with a resistance or tolerance to shocks, for the ball 1 to have the center of gravity at a center of the ball 1. As illustrated in FIG. 2 for instance, the ball 1 may have a cover arranged around the substrate 100, in the form of a combination of intermediate layer 101 and outer layer 102, to serve as a ball, while protecting those components 10 to 14 mounted on the substrate 100.

There may be an implementation including among others the intermediate layer 101 and the outer layer 102 made transparent or translucent for transmission of light from the light emitting element set 12. For instance, for among others the intermediate layer 101 and/or the outer layer 102, materials used may be butadiene rubber, silicon rubber, or natural rubber. The use of butadiene rubber is helpful for provision of a tolerance to shocks, but does need a heating at high temperatures (150° C. to 170° C.) for hardening. Hence, for use of butadiene rubber, those components 10 to 14 mounted on the substrate 100 may well be kept from being broken, by coating with a material having a low heat conductivity to form the intermediate layer 101, before providing thereon a surrounding coat of butadiene rubber to form the outer layer 102. It is noted that FIG. 2 shows an example composed of two layers being the intermediate layer 101 and the outer layer 102, while there may be a ball 1 composed of any layer number, providing a size and a weight to be both adequate, with properties such as a tolerance secured as necessary. Further, this ball 1 may have a layer made of metal, air, or the like interposed to absorb shocks.

Figure 3:
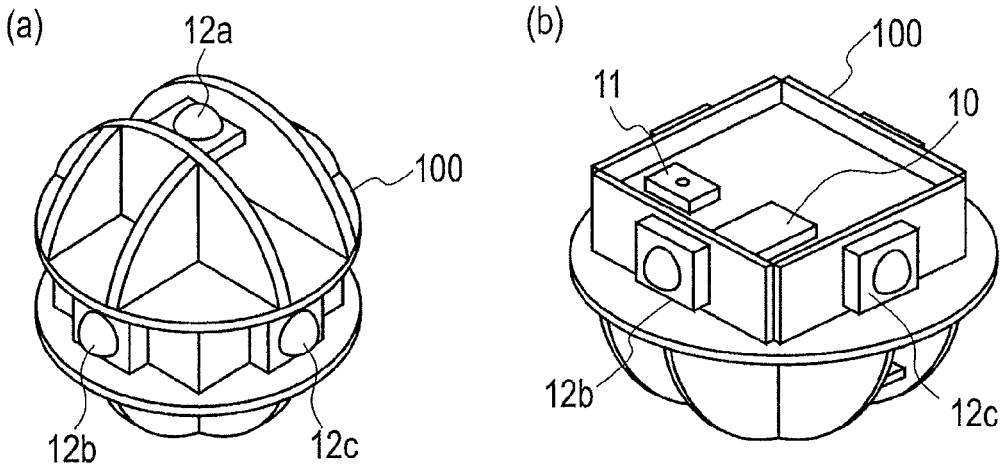
FIG. 3 is an explanatory diagram of a substrate in the ball shown in FIG. 1.

There may well be a substrate 100 configured to accommodate inside the ball 1, with a tolerance to shocks. In this respect, the substrate 100 may not be a single sheet of substrate, and may be configured with a plurality of substrate pieces sterically combined like an example illustrated in FIG. 3. The substrate 100 has an increased tolerance to shocks, when configured with substrate pieces assembled together to form a steric grid as illustrated in FIG. 3. FIG. 3(*a*) illustrates an assembled state of substrate 100, and FIG. 3(*b*), a state in the course of assembling substrate pieces. Illustrated in FIG. 3 is an example that has a set of light emitting elements 12*a* to 12*c* arranged on an outside of the assembled substrate, and a combination of acceleration sensor 10 and microphone 11 disposed inside the substrate 100 in the course of assembly. It is noted that the example shown in FIG. 3 has a controller 13 and a battery 14 both non-depicted.

Description is now made of specific examples of processes to be executed at the controller 13. The controller 13 is configured to implement those processes (processes 1 to 8) described below for instance. The processes described are unable to be wholly implemented at a time, while it is possible to implement any combination of user-selective processes.

(Process 1) Implementing a contiguous change in color, as the ball 1 inclines:

The ball 1 has an inclination, which can be defined by the combination of three axial accelerations. In this respect, the determiner 131 is adapted to define a change in inclination of the ball 1 from variations of accelerations input thereto. More specifically, the determiner 131 is adapted to work with variations of accelerations input thereto with prescribed levels defining an inclination, to determine the ball 1 as being inclined to an extent that causes a change in emission color. Further, the control processor 132 is adapted to work when the determiner 131 has determined that the ball 1 is inclined, to cause a color or colors at the light emitting element set 12 to change to a color or colors contiguous therewith in a preset pattern of emission color. For instance, the control processor 132 may work every time when a prescribed inclination is determined, to follow a sequence in order of red, orange, yellow, green, blue, indigo, and purple to emit light.

It is noted that besides the method of causing a change in color depending on an inclination, there may be use of a method of causing a change in emission color depending on among others a level of acceleration or a level of sound.

(Process 2) Implementing a non-contiguous change to another color upon reception of shock, as the ball 1 is given a shock:

The ball 1 may receive a shock, which can be defined by combination of a level of acceleration and a level of sound. In this respect, the determiner 131 is adapted to determine presence or absence of shock at the ball 1 from combination of a level of acceleration and a level of sound input thereto. More specifically, the determiner 131 is adapted to work when a level of acceleration input thereto corresponds to a level representative of a shock and also a level of sound input thereto corresponds to a level representative of a shock, to determine that the ball 1 is given a shock. That is, even when the level of acceleration corresponds to a level representative of a shock, if the level of sound does not correspond to any level representative of a shock, the determiner 131 is kept from determining that the ball 1 is given a shock. Further, the control processor 132 is adapted to work when the determiner 131 has determined that the ball 1 is given a shock, to cause a change in color at the light emitting element set 12. For instance, assuming a current emission of light in red in a preset sequence in order of red, orange, yellow, green, blue, indigo, and purple, the control processor 132 works to change the color to a non-contiguous one such as green.

(Process 3) Implementing a state changeover of the ball 1 by a specific period on a specific color set:

The control processor 132 is adapted to serve for among others repeating emission of light on a prescribed color set (being red, orange, yellow, green, blue, indigo, or purple) at a high rate, or repeating emission of light on a set of three colors (being red, green, and blue) at a low rate, for instance. That is, the determiner 131 is kept from working for determination on the basis of acceleration and sound, so the control processor 132 is always put in service for emission of light on a prescribed color set by a prescribed period. Assuming such the setting, the ball 1 is available as an instrument for illumination, as well.

(Process 4) Implementing emission of light on a specific color set when the ball 1 is thrown:

Whether the ball is thrown or not can be defined from combination of a level of acceleration and a level of sound. In this respect, the determiner 131 is adapted to work in accordance with combination of a level of acceleration and a level of sound, to determine whether or not the ball 1 is in a thrown state. More specifically, the determiner 131 is adapted to work when the level of acceleration corresponds to a level representative of a thrown state and also the level of sound corresponds to a level representative of a thrown state, to determine that the ball 1 is in a thrown state. That is, even when the level of acceleration corresponds to a level representative of a thrown state, if the level of sound does not correspond to any level representative of a thrown state, the determiner 131 is kept from determining that the ball 1 is in a thrown state. Further, for the ball 1 the determiner 131 has determined as being in a thrown state, the control processor 132 works to operate the light emitting element set 12 to emit light, for instance in red. After that, when the ball 1 is determined as being caught at the determiner 131, the control processor 132 works for control to cause emission of light by the original emission color or another emission color. Hence, the ball 1 being thrown may keep emitting light in red.

(Process 5) Implementing no emission of light when the ball 1 is thrown:

Whether the ball is thrown or not can be defined from combination of a level of acceleration and a level of sound, as described. In this respect, the determiner 131 is adapted to work in accordance with combination of a level of acceleration and a level of sound, to determine a state of the ball 1. For the ball 1 the determiner 131 has determined as being in a thrown state, the control processor 132 works to turn off the light emitting element set 12, whereby the ball 1 being thrown is kept in a state free of light emission. Further, when the ball 1 is caught, the control processor 132 works for control to cause emission of light by an original emission color or another emission color.

(Process 6) Implementing a strong emission of light when the ball 1 is given a significant shock:

The ball 1 may receive a shock, which can be defined by combination of a level of acceleration and a level of sound, as described. In this respect, the determiner 131 is adapted to determine a state of the ball 1 in accordance with combination of a level of acceleration and a level of sound. For the ball 1 the determiner 131 has determined as being given a shock, the control processor 132 works to make the luminance of light emitting element set 12 strong for a prescribed time (1 second for instance).

(Process 7) Implementing a blinking rate of ball changing in proportion to an acceleration of the ball 1:

For instance, the control processor 132 is adapted to work as the ball 1 has an increased acceleration, to make the blinking rate of light emitting element set faster. More specifically, there is a program defining a preset relationship between accelerations and blinking rates, whereby the control processor 132 is adapted to work to have the light emitting element set 12 blink on and off at a blinking rate corresponding to an input acceleration.

(Process 8) Implementing a low blinking rate when the ball 1 is left unattended:

Whether the ball 1 is left unattended or not can be defined from a variation of acceleration. In this respect, the determiner 131 is adapted to work at prescribed intervals of time, to determine presence or absence of variation in acceleration. More specifically, the determiner 131 is adapted to work with lapse of a prescribed time free of variations in input acceleration, to determine that the ball 1 is left unattended. For the ball 1 the determiner 131 has determined as being left unattended, the control processor 132 works to have the light emitting element set 12 blink on and off at a low blinking rate. For lapse of a prescribed time free of variations after blinking, the control processor 132 may work to turn off the light emitting element set 12.

Figure 4:
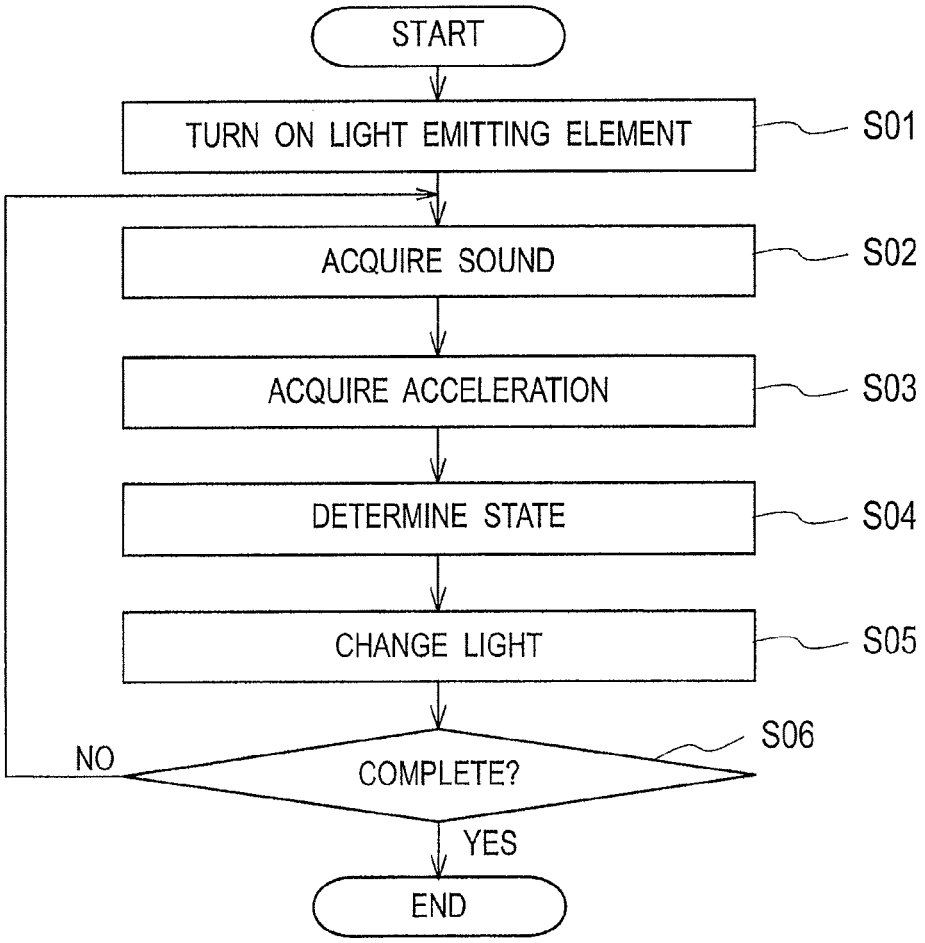
FIG. 4 is a flowchart of an example of process executed in the ball shown in FIG. 1.

Description is now made of a flow in a processing at the ball 1, with reference to a flowchart shown in FIG. 4. FIG. 4 shows an example described as having the process 1 and the process 6 selected in a program stored in the controller 13. In this example, the ball 1 has a power supply (non-depicted). The power supply is operable to turn on to start the processing shown in FIG. 4. The power supply is operable to turn off to end the processing shown in FIG. 4.

First, the light emitting element set 12 is turned on (S01). Thereafter, the acceleration sensor 10 acquires an acceleration developed in a motion of the ball 1 to output to the controller 13 (S02). Also the microphone 11 acquires a produced sound from inside the ball 1 to output to the controller 13 (S03).

After that, the determiner 13 works to determine whether or not a level of acceleration acquired at the acceleration sensor 10 corresponds to a level defining an inclination and a level for determination on shock, and determine whether or not a level of sound acquired at the microphone 11 corresponds to a level defining a shock, to thereby determine a state of the ball 1 (S04). The control processor 132 works in accordance with a result of determination at the step S4, to determine the luminance and an emission color of light to be emitted at the light emitting element set 12, and change the luminance and emission color (S05).

More specifically, when it is determined from an acceleration acquired at the acceleration sensor 10 that the ball 1 has a prescribed inclination developed therewith, the control processor 132 works on a current emission color, to change the emission color in accordance with a pattern set up therefor complying with the rule of process 1. Further, when it is determined from combination of a level of acceleration acquired at the acceleration sensor 10 and a level of sound acquired at the microphone 11 that the ball 1 is given a shock, the control processor 132 works to follow the rule of process 6 to make the luminance strong for a prescribed time.

The light emitting element set 12 is caused to blink at the step S05, and afterward, the ball 1 repeats (S06) processes at the steps S02 to S05, till it goes to an end.

As described, according to the first embodiment, the ball 1 is adapted to operate making use of an acceleration of the ball 1 and a produced sound in the ball, to make a correct determination on a state of the ball1, to cause the light emitting element set 12 of the ball 1 to change the emission color, luminance, and blinking rate. For instance, the ball 1 may have a strong acceleration developed therewith at the instant when the ball 1 is thrown, and at the instant when the ball 1 is given a shock, which are difficult to distinguish by simply using acceleration. To this point, the ball 1 employs both of acceleration and sound, to grasp a state of the ball 1, as described, enabling a distinction among situations difficult to distinguish, such as between the instant when the ball 1 is thrown and the instant given a shock. This is because, when given a shock, the ball 1 has large sounds produced therein, affording to acquire a high level of sound, but at the instant when the ball 1 is thrown, even if the acceleration was identical to that when given a shock, the ball 1 would be free of large sounds produced therein, so the level of sound then acquired should be low.

The ball 1 described thus affords for users to give shocks to the ball 1, by actions such as attendant a dribbling, a heading, or a juggling or by use of an object such as a bat or a racket, causing changes in states of light emission, such as emission color, emitting light intensity, and blinking rate, to develop every timing of shock given. This allows for users of the ball 1 as well as audience of games using the ball 1 to experience among others an enhanced exhilaration or enhanced excitation.

It is noted that the ball 1 may have a connector for connection with an information processing device such as a personal computer, for instance, to permit a program stored in the controller 13 to be updated anew from an external device.

<First Modification>

Figure 5:
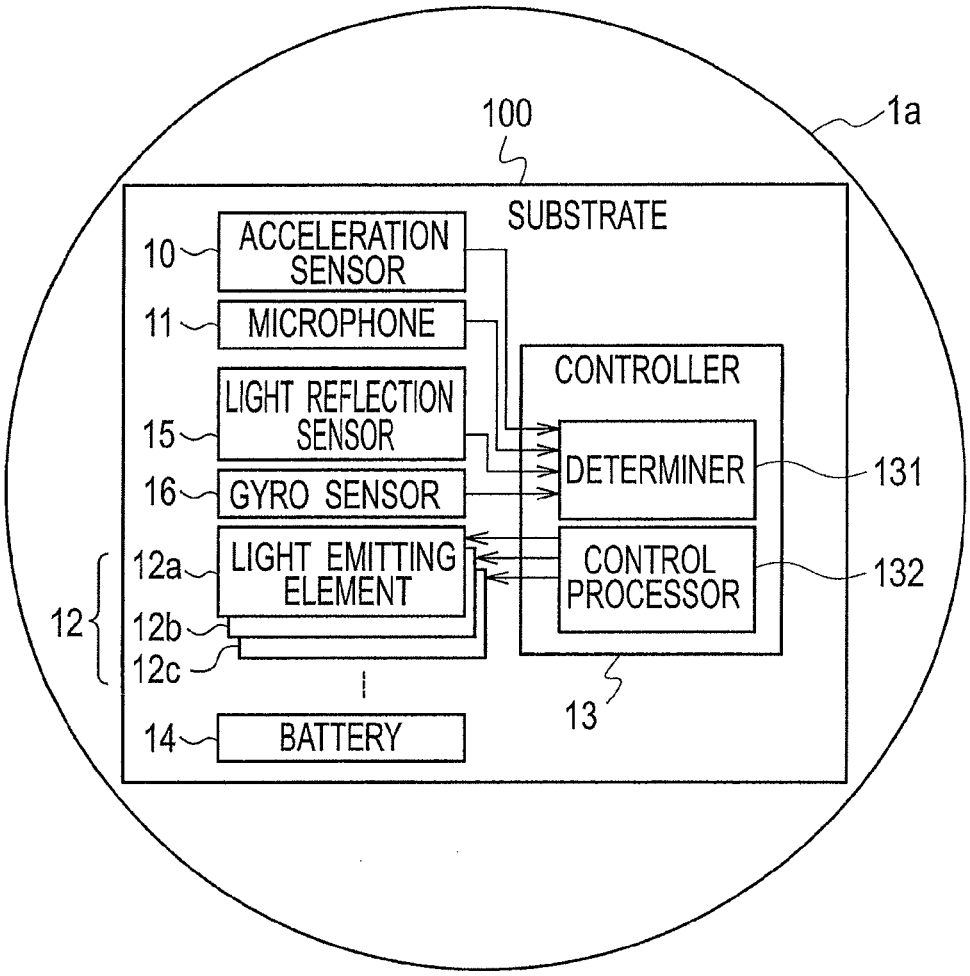
FIG. 5 is a schematic diagram of a ball according to a first modification of the first embodiment of the present invention.

FIG. 5 shows a ball 1*a* according to a first modification of the first embodiment, which is different from the ball 1 described with reference to FIG. 1, in that it includes a light reflection sensor set 15 and a gyro sensor (gyroscope) 16.

The ball 1*a* includes an acceleration sensor 10, a microphone 11, a light emitting element set 12, a controller 13, and a battery 14, which are each configured to be identical to a corresponding one described with reference to FIG. 1, and designated at an identical reference sign to omit redundant description.

Figure 6:
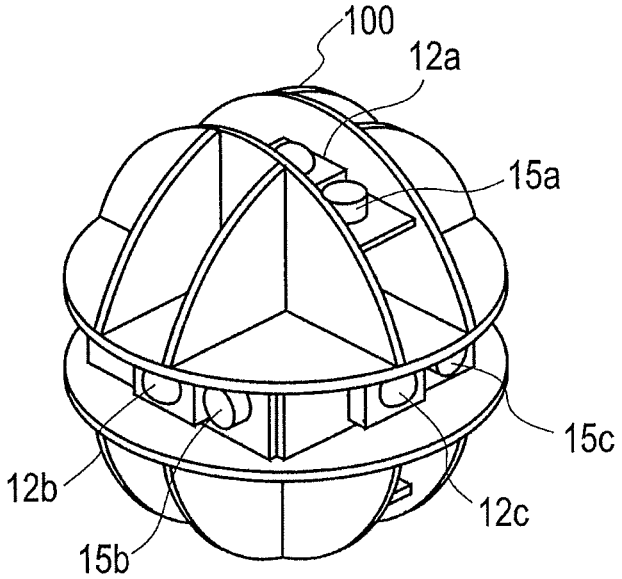
FIG. 6 is an explanatory diagram of a substrate in the ball shown in FIG. 5.
Figure 6:
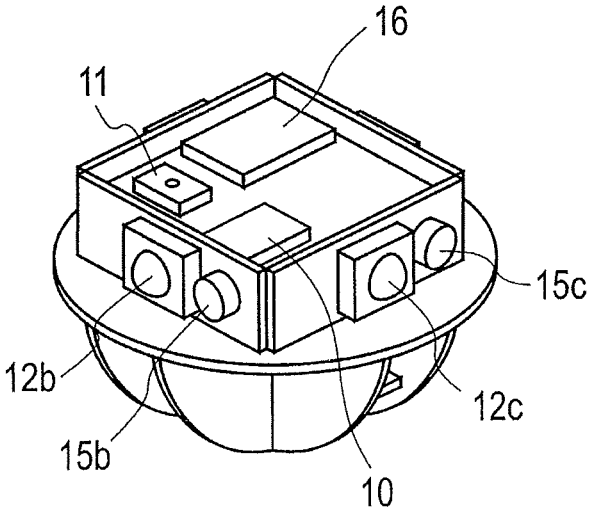

Like the example described with reference to among others FIG. 2 and FIG. 3, the ball 1*a* has components thereof (including the acceleration sensor 10, the microphone 11, the light emitting element set 12, the controller 13, the battery 14, and the light reflection sensor set 15 (15*a* to 15*c*)) arranged as illustrated in FIG. 6 for instance, that is, mounted on a substrate 100, and covered with a set of layers such as an intermediate layer 101 and an outer layer 102. It is noted that FIG. 6(*a*) illustrates an assembled state of the substrate 100, and FIG. 6(*b*), a state in the course of assembling pieces of the substrate 100.

Light reflection sensors 15 each comprise an element configured with a light emitter (non-depicted) for emitting light and a light receiver (non-depicted) for receiving reflected light of emitted light, to detect presence or absence of a reflecting object. The light emitter and the light receiver are oriented in an identical direction (outward of the ball). The ball 1*a* may well have a certain plurality of light reflection sensors 15.

For instance, in a situation the ball 1*a* is rolling on a floor, there may be a light reflection sensor 15 brought into contact with the floor, when its light receiver is to receive a beam of light emitted from its light emitter and reflected on the floor. Or in a situation the ball 1*a* is being handled by a person, there may be a light reflection sensor 15 put in position under a hand of the person, when its light receiver is to receive a beam of light emitted from its light emitter and reflected on the hand.

Accordingly, there is a detection signal output from the light reflection sensor 15, permitting a determiner 131 to determine whether or not the ball 1*a* is rolling on a floor, or being stoked by a person. Moreover, the determiner 131 can use detection signals from a plurality of light reflection sensors 15, to work when the ball 1*a* is rolling on a floor, to determine which part of the ball 1*a* is brought into contact with the floor or not. Further, the determiner 131 can use detection signals from a plurality of light reflection sensors 15, to work when the ball 1*a* is stoked by a person, to determine which part of the ball 1*a* is stoked.

Figure 16:
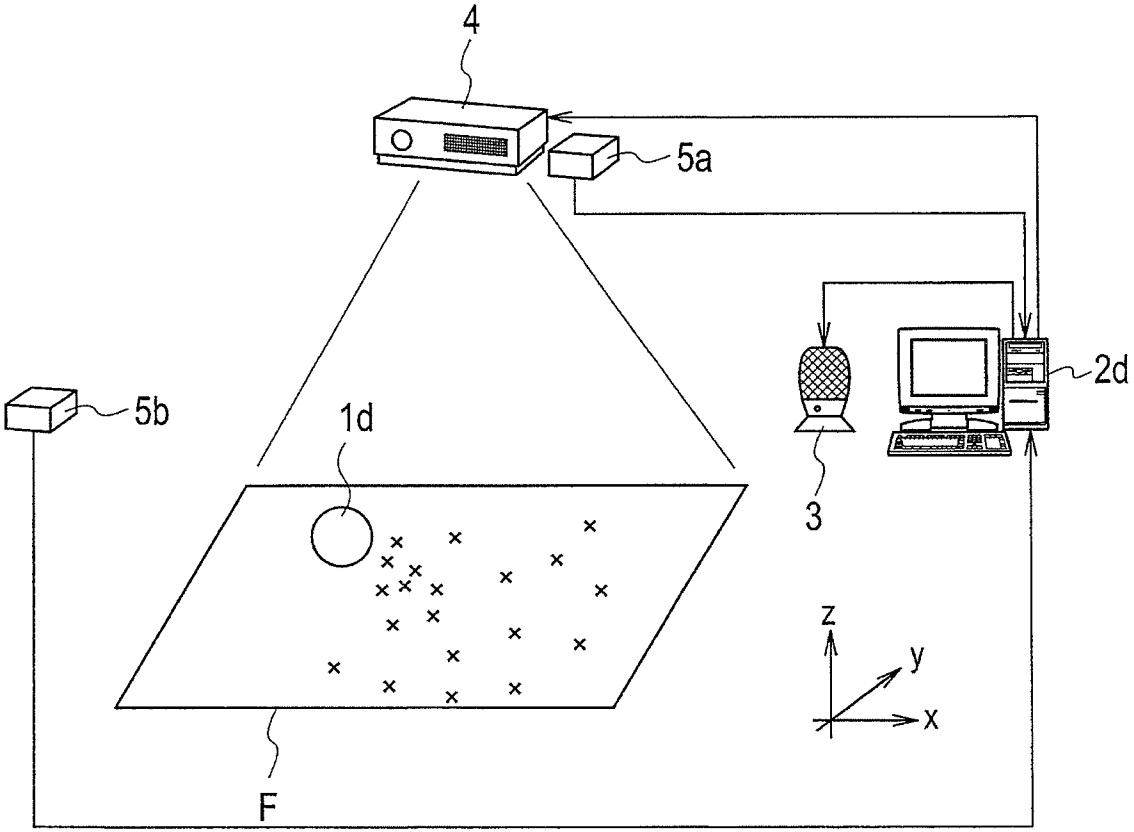
FIG. 16 is a conceptual diagram of an entertainment system according to a first modification of the third embodiment of the present invention.

Further, in the example shown in FIG. 16, the light reflection sensors 15 are each disposed in a vicinity of light emitting element 15, thus permitting a control processor 132 to work for, among others, changing emission colors of light emitting elements 11 in order from an element located in position where the rolling ball 1*a* is contacting on the floor or getting off from the floor, or changing an emission color of a light emitting element 12 located in position where the ball 1*a* is being stoked by a person.

The gyro sensor 16 is a device adapted to detect an angular speed as an amount of variation in angle as necessary to measure a gyre of the ball 1*a*.

Therefore, in situations such as when the ball 1*a* is thrown or rolling, the determiner 131 can use a detection signal from the gyro sensor 16, to work for identification of those parts located in position at the top and bottom, front and rear, and right and left of the ball 1*a*. Further, the determiner 131 can use a detection signal from the gyro sensor 16, to work to define a rolling speed of the ball 1*a*.

Further, the control processor 132 can work depending on a result of determination at the determiner 131, to cause a change simply at a light emitting element 12 lying in a single direction, such as that simply at a light emitting element 12 lying ahead, or simply at a light emitting element 12 lying in the back, in a traveling direction of, or simply under, the ball 1*a* in a thrown state or the ball 1*a* in a rolling state.

According to the first modification described, the ball a is provided with a light reflection sensor set 15 and a gyro sensor 16, affording to detect a rolling of the ball 1*a* on a floor, while detecting among others a variation in speed of rotation or rolling direction of the ball 1*a*. That is, it can use the light reflection sensor set 15 and the gyro sensor 16 as well as the acceleration sensor 10 and the microphone 11, for operation when the ball 1*a* is brought into contact with a wall, floor, or user's body, to define how the ball 1*a* has contacted therewith. Further, it can work when the ball 1*a* is put in a contacting (frictional) state, to detect the direction of rotation, the timing of change in speed of rotation, and the amount of variation. Therefore, the ball 1*a* affords to set up methods of outputting among others light and sound in accordance with particulars in state of the ball 1*a*, allowing users to experience an enhanced degree of satisfaction.

It is noted that the ball 1*a* shown in FIG. 5 has an acceleration sensor 10 and a microphone 11, as well as a light reflection sensor set 15 and a gyro sensor 16, while there may be a ball implemented with either or both of a light reflection sensor set 15 and a gyro sensor 16, including neither acceleration sensor 11 nor microphone 10.

<Second Modification>

Description is now made of a ball according to a second modification of the first embodiment. Unlike the first modification in which emission of light from a light emission element set 12 is controlled by use of an acceleration acquired through an acceleration sensor 10 and a sound acquired through a microphone 11, the ball according to the second modification simply use a sound acquired through a microphone 11 for control of a light emission element set 12.

More specifically, the ball according to the second modification includes a controller 12 adapted to implement those processes (processes A1 to A4) described below. The processes described are unable to be wholly implemented at a time, while it is possible to implement any combination of user-selective processes.

(Process A1) Implementing a change of emission color, as the ball 1 is given a shock:

Whether the ball is given a shock or not can be defined from a level of sound acquired through the microphone 11. In this respect, there is a determiner 131 adapted to work with a level of sound input thereto exceeding a prescribed level as it is preset, to determine that the ball is given a shock. Further, there is a control processor 132 adapted to work when the determiner 131 has determined that the ball is given a shock, to cause a change in color at the light emitting element set 12 to a color contiguous in a preset pattern of emission color. For instance, the control processor 132 works each time of determination that a shock is given, to have the light emitting element set 12 emit a color of light in order of red, orange, yellow, green, blue, indigo, and purple.

(Process A2) Implementing a strong emission of light when the ball is given a shock:

The control processor 132 is adapted to work with the determiner 131 having determined that the ball is given a shock, to make the luminance of light emitting element set 12 strong for a prescribed time (1 second for instance).

(Process A3) Implementing emission of a specific color of light when the ball is given a shock:

The control processor 132 is adapted to work with the determiner 131 having determined that the ball is given a shock, to have the light emitting element set 12 emit a specific color of light for a prescribed time (1 second for instance).

(Process A4) Implementing a blinking when the ball is given a shock:

The control processor 132 is adapted to work with the determiner 131 having determined that the ball is given a shock, to have the light emitting element set 12 blink on and off for a prescribed time (1 second for instance).

According to the second modification described, there is a ball adapted to operate simply making use of a produced sound in the ball, to determine a state of the ball, to control an output (emission of light at a light emitting element set 11) of the ball. This allows for a facilitated configuration of ball, as well as a facilitated implementation of processes at a controller 13.

<Third Modification>

Figure 7:
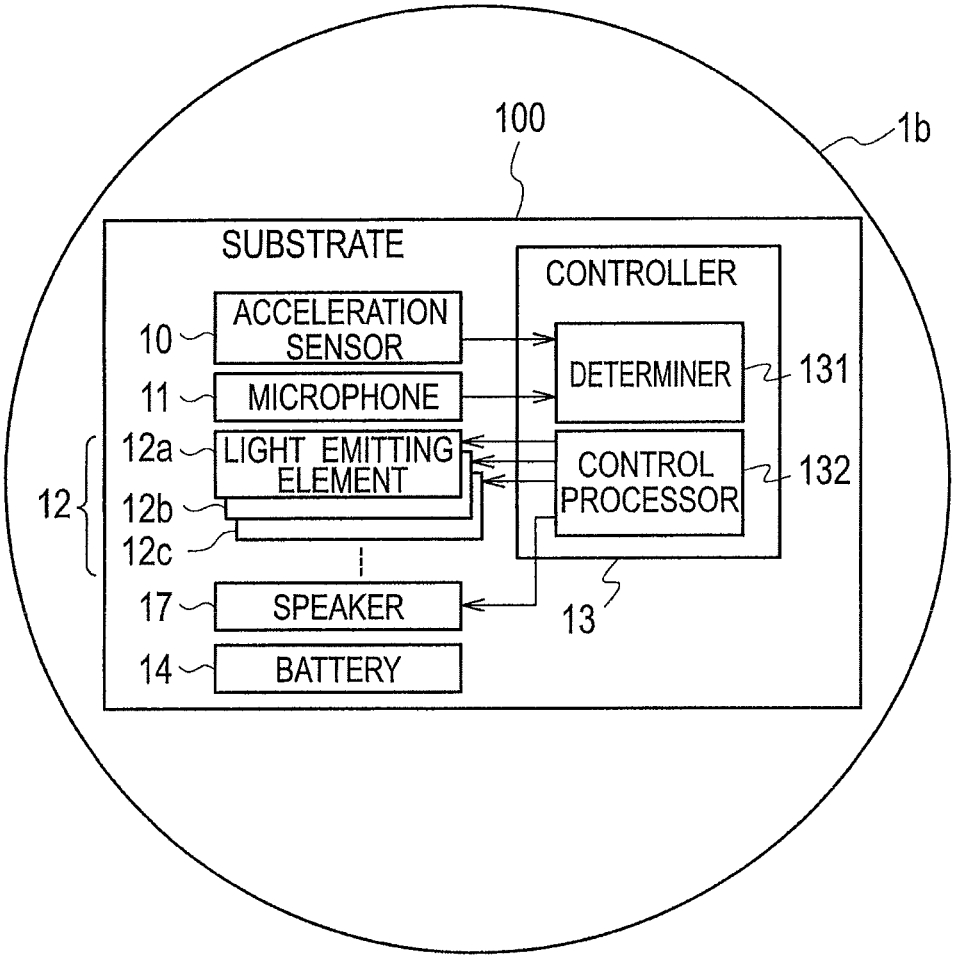
FIG. 7 is a schematic diagram of a ball according to a third modification of the first embodiment of the present invention.

FIG. 7 shows a ball 1*b* according to a third modification of the first embodiment, which is different from the ball 1 described with reference to FIG. 1, in that it includes a speaker 17. That is, the ball 1*b* includes, as an outputter or means for outputting a signal or signals in accordance with a state of the ball 1*b*, both of a light emitting element set 12 for emitting light commensurate with a state of the ball 1*b* and the speaker 17 for outputting sounds commensurate with a state of the ball 1*b*.

The ball 1*a* includes an acceleration sensor 10, a microphone 11, the light emitting element set 12, the controller 13, and a battery 14, which are each configured to be identical to a corresponding one described with reference to FIG. 1, and designated at an identical reference sign to omit redundant description. Like the example described with reference to among others FIG. 2 and FIG. 3, the ball 1*b* has components thereof (including the acceleration sensor 10, the microphone 11, the light emitting element set 12, the controller 13, the battery 14, and the speaker 17) arranged on a substrate 100, and covered with a set of layers such as an intermediate layer 101 and an outer layer 102.

For the ball 1*b* provided with a light emitting element set 11 and a speaker 17, the controller 12 of the ball 1*b* may be adapted to implement those processes (processes B1 and B2) described below, in addition to the above-noted processes A1 to A4, for instance.

(Process B1) Implementing a specific sound as an output when the ball 1*b* is given a shock:

There is a control processor 122 adapted to work with a determiner 121 having determined that the ball 1*b* is given a shock, to have the speaker 17 output a specific sound.

(Process B2) Implementing an increased sound as an output when the ball 1*b* is given a shock:

The control processor 122 is adapted to work with the determiner 121 having determined that the ball 1*b* is given a shock, to have the speaker 17 output an increased volume of sound for a prescribed time (1 second for instance).

According to the second modification described, there is a ball 1*b* including a speaker 17 in addition to a light emitting element set 11, as an output means for outputting a signal in accordance with a state of the ball 1*b*. Therefore, the ball 1*b* is adapted to cause a change of sound together with a change of light in accordance with a state of the ball 1*b*, allowing for increased interests to users of the ball 1*b* as well as to audience of games using the ball 1*b*. That is, the ball 1*c* affords for users to give shocks thereto, by actions such as attendant a dribbling, a heading, or a juggling or by use of an object such as a bat or a racket, causing changes in among others a state of light as well as a state of sound output from the ball 1*b*, to develop every timing of shock given, thus allowing for users of the ball 1*b* as well as audience of games using the ball 1*b* to experience among others an enhanced exhilaration or enhanced excitation.

It is noted that FIG. 7 shows a ball 1*b* including, as output means for outputting a signal in accordance with a state of the ball 1*b*, both of a light emitting element set 11 and a speaker 17, to output signals from the light emitting element set 11 and the speaker 17, while affording to simply implement an output of sound from the speaker 17, subject to similar effects to be available simply from the output of the speaker 17. For instance, contrary to the difficulty to verify changes of light emitted from the light emitting element set 11 under strong sunshine, output sounds should be clear even under strong sunshine. Therefore, under such situations, there may be use of the speaker 17 only.

Second Embodiment

Figure 8:
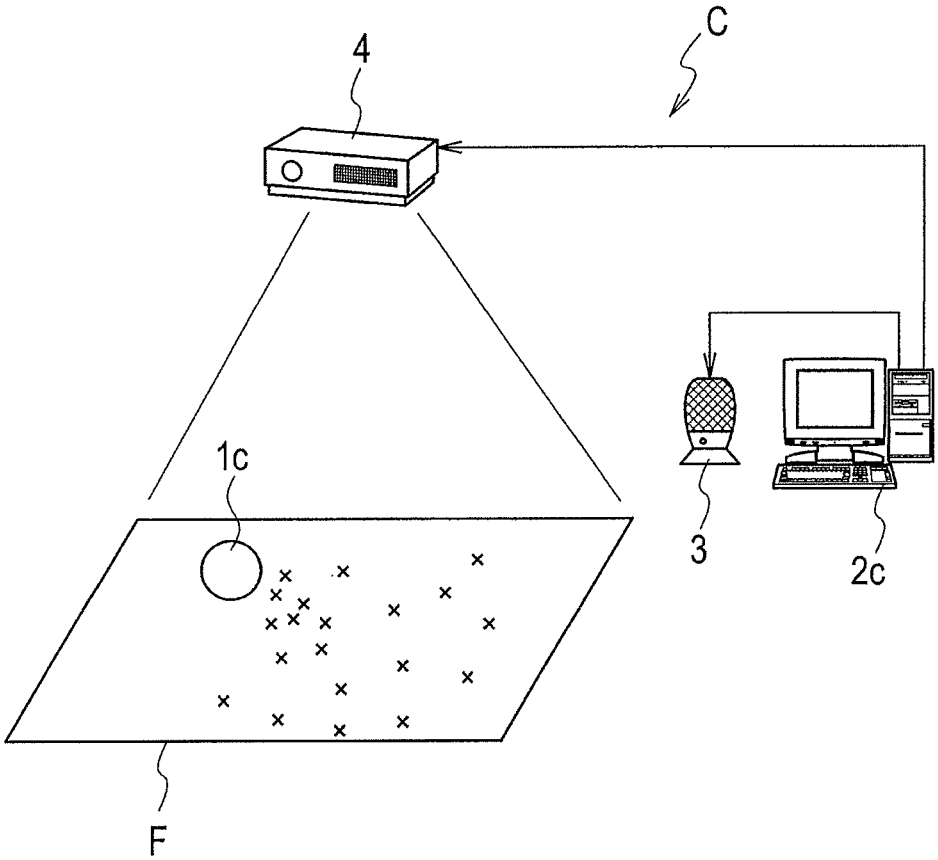
FIG. 8 is a conceptual diagram of an entertainment system according to a second embodiment of the present invention.

Description is now made of an entertainment system according to a second embodiment. According to the second embodiment of the present invention, as illustrated in FIG. 8, there is an entertainment system C including a ball 1*c*, a control device 2*c* configured to control the ball 1*c*, and a combination of a speaker 3 and a projection device 4 configured to coordinate with the ball 1*c* under control of the control device 2*c*.

For the entertainment system according to the second embodiment, the ball 1*c* is similar in configuration in part to the ball 1 shown in FIG. 1, of which components are each designated at an identical reference sign to omit redundant description. As shown in FIG. 7, the ball 1*c* is different from the ball 1 shown in FIG. 1, in that it has a controller 13*c* substituting for the controller 13, and includes a communication interface (communication I/F) 18.

The communication I/F 18 is configured as an interface to implement wireless transmission and reception of data between the ball 1*c* and the control device 2*c*, and adapted for a service under control from the controller 13*c* to transmit an ID for identification of the ball 1*c* to the control device 2*c*. The communication I/F 18 is adapted also for services to transmit an acceleration, a sound, and a current emission color input to the controller 13*c* to the control device 2*c*, and receive change data transmitted from the control device 2*c* in response to the acceleration and the sound, to output the received change data to the controller 13*c*.

The controller 13*c*, a miniature device such as a microcomputer, has stored therein a program configured to control a light emitting element set 12 for emission of light. The controller 13*c* is configured to work on the program to implement an ID transmitter 133 for transmitting an ID for identification of the ball 1*c* at a prescribed timing through the communication I/F 18 to the control device 2*c*, a transmission processor 134 for transmitting an acceleration input thereto from an acceleration sensor 10, a sound input thereto from a microphone 11, and a current emission color through the communication I/F 18 to the control device 2*c*, and a control processor 135 for receiving change data (signals) transmitted from the control device 2*c* through the communication VF 18, to follow to thereby control the light emitting element set 12.

That is, the controller 13*c* shown in FIG. 7 is adapted for use of change data received from the control device 2*c* to control the light emitting element set 12, unlike the controller 13 shown in FIG. 1 in which the controller 13 executes a determination by itself, to work depending on a result thereof to control a light emitting element set 12.

Figure 9:
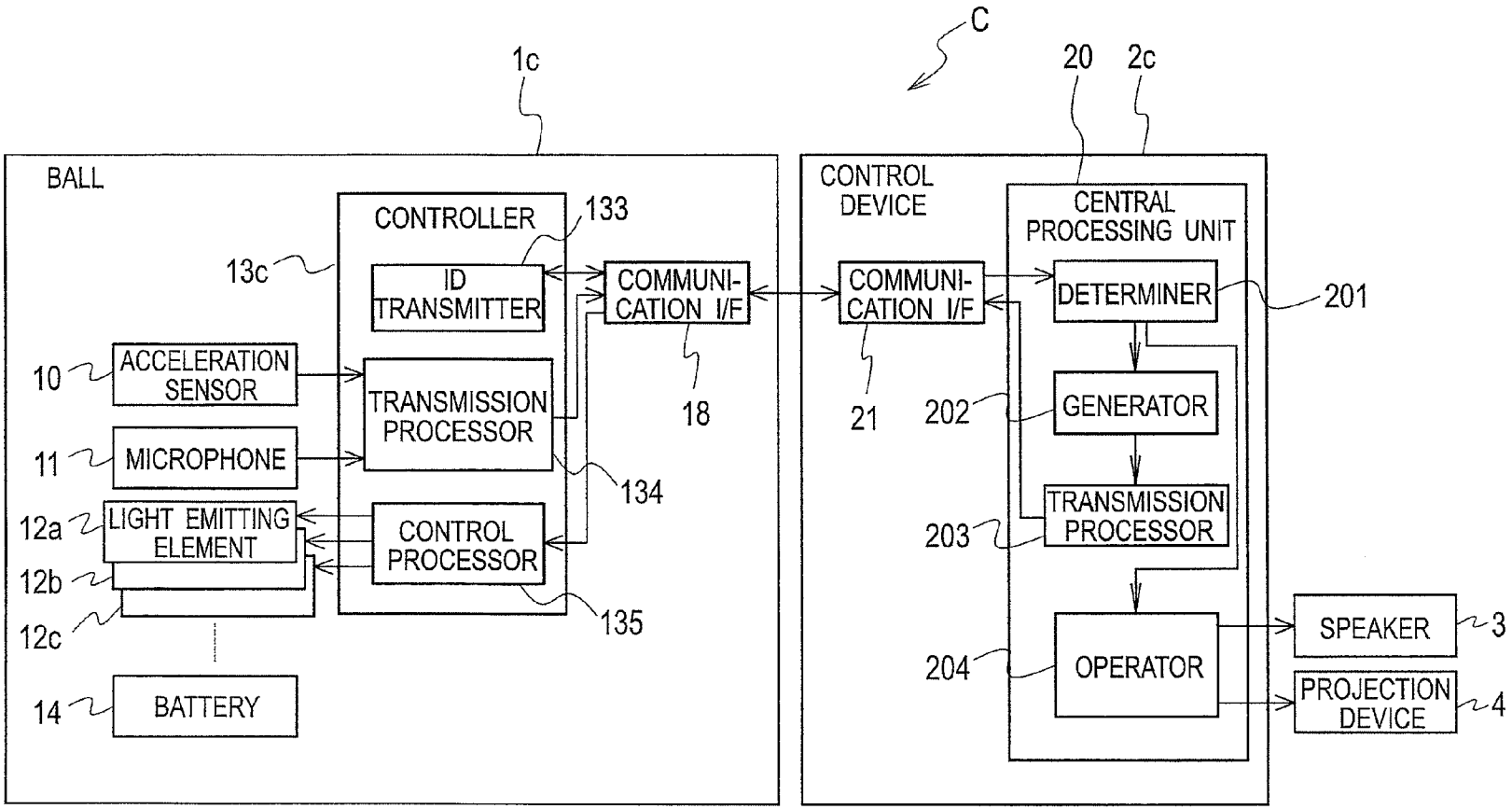
FIG. 9 is a diagram of configuration of the entertainment system shown in FIG. 8.

It is noted that like the ball shown in FIG. 1, the ball 1*c* has components 10 to 18 thereof mounted on a substrate 100, and covered with a set of layers such as an intermediate layer 101 and an outer layer 102, while the substrate 100, the intermediate layer 101, and the outer layer 102 are non-depicted in FIG. 9.

The control device 2*c* includes a communication interface (communication I/F) 21 configured to implement transmission and reception of data to and from the ball 1*c*, and a central processing unit 20 adapted to control the ball 1*c*. The control device 2*c* is made up by a typical computer that includes a central processor constituting the central processing unit 20 and the communication I/F 21 and besides memories and input/output interfaces (non-depicted), which is configured to read an entertainment program stored in a memory, to install in the central processing unit 20, to thereby implement in the central processing unit 20 a determiner 201 for determining a state of the ball 1*c* in accordance with among others a level of acceleration and a level of sound received from the ball 1*c*, a generator 202 for generating a change data to change emission of light at the ball 1*c* in accordance with a result of the determination, a transmission processor 203 for transmitting the change data to the ball 1*c*, and an operator 204 for operating the speaker 3 and the projection device 4 in accordance with a state of the ball 1*c*.

The determiner 201 is adapted to determine a state of the ball 1*c* in accordance with combination of a level of acceleration received from the ball 1*c* and a level of sound received from the ball 1*c*.

The generator 202 is adapted to work, as it has received from the ball 1*c* a current emission color of the ball 1*c* together with an acceleration and a sound, to generate change data for use to change among others the color and the luminosity of light emitted from the light emitting element set 12 relative to the current emission color in accordance with a result of determination at the determiner 201.

In the central processing unit 20, there are processes implemented for determination at the determiner 201 and for generation of change data at the generator 202, whereto used may be such processes as identical to the process 1 to process 8 described in conjunction with the first embodiment, for instance.

The transmission processor 203 is adapted to transmit change data (signals) generated at the generator 202 to the ball 1*c*, through the communication I/F 21.

The operator 204 is adapted to operate the speaker 3 and the projection device 4 in accordance with a state of the ball 1*c* the determiner 201 has determined. For instance, the operator 204 is adapted to work when the determiner 201 has determined that the ball 1*c* is thrown, to operate the speaker 3 to provide a sound effect corresponding to a state of the ball 1*c* being thrown, as will be described later on. Moreover, the operator 204 is adapted to work when the determiner 201 has determined that the ball 1*c* is given a shock, to operate the speaker 3 to provide a sound effect corresponding to a state of the ball 1*c* given a shock. Further, the operator 204 is adapted to operate the projection device 4 to change a projected color, image, picture, or the like at a rate commensurate with an acceleration determined at the determiner 201, as will be described later on. In addition, the operator 204 is adapted to work when the determiner 201 has determined that the ball 1*c* is given a shock, to operate the projection device 4 to render among others a picture projected or a projection color changed commensurately with a state the ball 1*c* should have upon reception of the shock or with the impact.

The speaker 3 is configured to follow operations from the control device 2*c*, to output sounds. Also the projection device 4 is configured to follow operations from the control device 2*c*, to work for projection of color, image, picture, or the like. For instance, the control device 2*c* may operate the projection device 4 to project letters, ripples, geometric patterns, or the like on a playing field of sport using the ball 1*c*, and cause a change of projected image or such in accordance with a motion of the ball 1*c*.

It is noted that this embodiment employs a projection device 4 described as a measure for outputting an image signal, while this is not limited to the projection device 4, and can do well with an imaging and lighting device configured to output among others an image signal and a light signal to a playing field for playing any sport using the ball 1*c*. Specifically, the imaging and lighting device may be a lighting device configured simply for emission of light variable in color. Or else, the imaging and lighting device may be a display such as an electric scoreboard installed in a playing field and adapted to change among others displayed images and colors of light. Further, this may be a system including a display unit put on a floor, to display among others images and light being changed, while permitting a user to play with the ball 1*c*.

Figure 10:
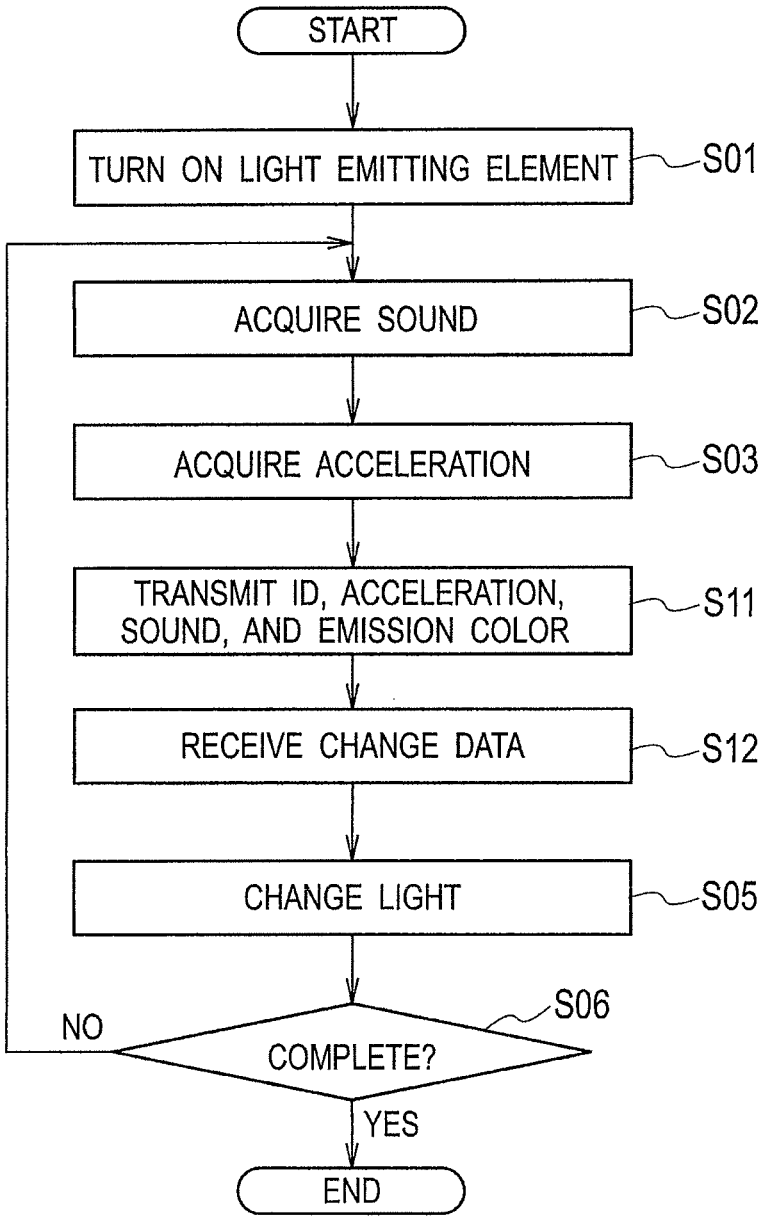
FIG. 10 is a flowchart of an example of process executed in a ball shown in FIG. 9.

Description is now made of a flow in a processing at the ball 1*c*, with reference to a flowchart shown in FIG. 10. The flowchart shown in FIG. 10 includes such processes as identical to processes in the flowchart shown in FIG. 4, which are each designated at an identical reference sign to omit redundant description. hr this example, the ball 1*a* has a power supply (non-depicted). The power supply is operable to turn on to start the processing. The power supply is operable to turn off to end the processing.

With the light emitting element set turned on and accelerations and sounds acquired (S01, S02, and S03), the ID transmitter 133 transmits an ID for identification of the ball 1*c* through the communication I/F 18 to the control device 2*c*, and the transmission processor 134 transmits an acceleration acquired through the acceleration sensor 10 at the step S02 and a sound acquired through the microphone 11 at the step S03 through the communication I/F 18 to the control device 2*c* (S11). Having received the ID transmitted at the step S11, the control device 2*c* is enabled to identify the ball 1*c* as a target of control.

In response to the acceleration and the sound transmitted at the step S11, the control device 2*c* transmits a set of change data, which is received through the communication I/F 18 (S12), whereby the control processor 135 is put in service for working on received change data to cause changes in color and luminosity of light emitted at the light emitting element set 12 (S04). After that, the ball 1*c* repeats (S06) processes at the steps S02 to S06, till it goes to an end.

It is noted that the light emitting element set 12 is operative to cause a change in emission color in accordance with a motion of the ball 1*c*, for which there may be parallel processes implemented for among others acquisition of acceleration and sound, transmission of acceleration and/or sound, and change in emission color.

Figure 11:
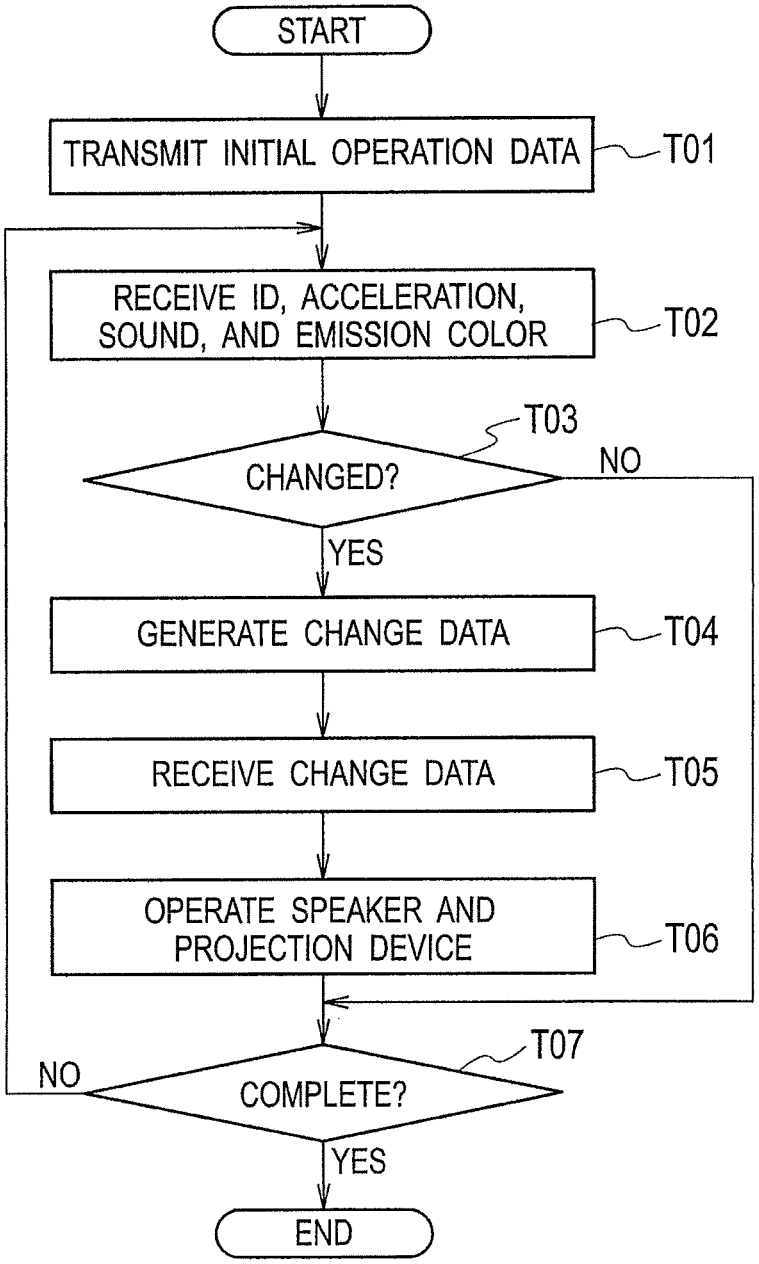
FIG. 11 is a flowchart of an example of process executed in a control device shown in FIG. 9.

Description is now made of a flow in a processing at the control device 2*c*, with reference to a flowchart shown in FIG. 11. FIG. 11 shows an example that has a program stored in the central processing unit 20, in which the process 1 and the process 6 described are selected. In this example, the central processing unit 20 has a power supply (non-depicted). The power supply is operable to turn on to start the processing. The power supply is operable to turn off to end the processing.

First, at the central processing unit 20, the operator 204 transmits initial operation data to the speaker 3 and the projection device 4 (T01). Here, the operation data the operator 204 has transmitted includes data for operating the speaker 3 and the projection device 4 when starting the entertainment system. The speaker 3 follows given initial operation data to output a sound for startup, and the projection device 4 follows given initial operation data to project a picture for startup.

After that, the control device 2*c* receives through the communication I/F 21 an ID transmitted from the ball 1*c*, together with a combination of acceleration, sound, and emission color transmitted from the ball 1*c* (T02). The control device 2*c* stores any received ID in a memory (non-depicted) for ID management of any ball constituting a target of the processing. When the ID received together with the combination of acceleration, sound, and emission color coincides with an ID stored in the memory, the control device 2*c* is allowed to determine the ball as being a control target put under a continued control.

The determiner 131 works to determine whether or not a level of acceleration as received corresponds to a range of levels defining an inclination and a range of levels defining a shock, and determine whether or not a level of sound as received corresponds to a range of levels defining a shock, to thereby define a state of the ball 1*c*, to determine whether or not the light emitting element set 12 should be operated to cause a change in emission of light (T03).

If the light emitting element set 12 should be operated to cause a change in emission of light (YES at T03), then the generator 202 works to generate change data (T04) for use to cause changes in emission color and luminosity in accordance with a state of the ball 1*c* defined by determination at the step T03. As a state of the ball 1*c* is defined, the transmission processor 203 works to transmit (T05) the change data the generator 202 has generated at the step T04, to the ball 1*c*.

Further, the operator 204 works to operate the speaker 3 and the projection device 4 (T06) in accordance with a state of the ball 1*c* defined by determination at the step T03.

After that, the controller 13 repeats (T07) processes at the steps T03 to T06, till it goes to an end.

According to the second embodiment of the present invention described, there is an entertainment system C including a control device 2*c* configured to work in accordance with a state (motion) of a ball 1*c*, to control emission of light at a light emitting element set 12, and control among others an output sound from a speaker 3 and a projected picture by a projection device 4. Hence, there is emission of light from the ball 1*c* combined with a space involving the ball 1*c* rendered with among others a frame of images projected thereon and sounds output thereabout, allowing for an enhanced degree of satisfaction of user of the ball 1*c*.

For instance, the entertainment system C is adaptive for application to games such as soccer, bowling, billiard, tennis, ping-pong, and dodge ball using a ball within a prescribed area, as well as for contribution to proposal of a new game. That is, such the area can be rendered with a picture or the like projected from the projection device 4 and sounds output from the speaker 3 in accordance with among others a motion of the ball or progress of the game.

It is noted that in the first embodiment, assuming a typical use of ball in the dark, there may be a solar cell used as the battery 14, with need to put the ball 1 in the light to charge. To this point, according to the second embodiment, the ball 1*c* is used under provision of a projection device 4, affording to generate power also by use of light emitted from the projection device 4 while playing.

It also is noted that in the above-noted example, the ball 1*c* may be configured with among others a light reflection sensor set 15 and/or a gyro sensor 16, as such the configuration may be implemented with one or more components out of a microphone 10, an acceleration sensor 15, a light reflection sensor set 16, and a gyro sensor 17.

Further, it is noted that the entertainment system C shown in FIG. 8 and FIG. 9 includes both of speaker 3 and projection device 4, while it can do well with either of them, or may have a speaker incorporated in the ball 1*c*, substituting for the speaker 3, allowing for use of a speaker in the ball 1*c*.

Third Embodiment

Figure 12:
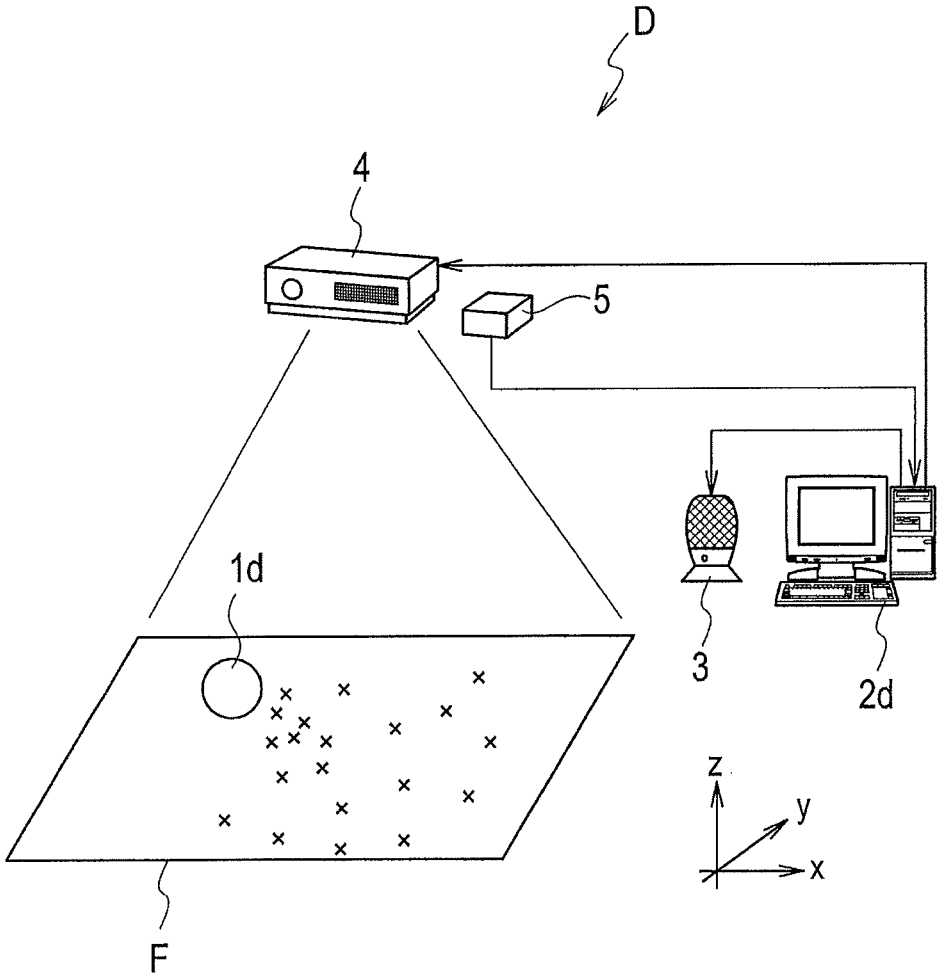
FIG. 12 is a conceptual diagram of an entertainment system according to a third embodiment of the present invention.

Description is now made of an entertainment system according to a third embodiment. According to the third embodiment of the present invention, as illustrated in FIG. 12, there is an entertainment system D including a ball 1*d*, a control device 2*d* configured to control the ball 1*d*, a combination of a speaker 3 and a projection device 4 configured with coordinate with the ball 1*d* under control of the control device 2*d*, and an infrared detector 5 configured to detect the ball 1*d*. As shown in FIG. 12, the entertainment system D is different from the entertainment system C shown in FIG. 8 according to the second embodiment, in that it includes the infrared detector 5.

Figure 13:
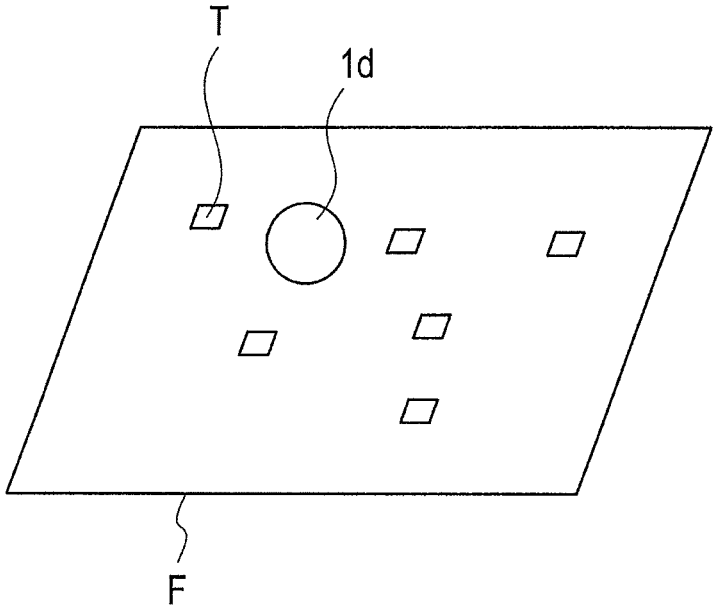
FIG. 13 is an explanatory diagram of a target projected by a projection device shown in FIG. 12.

FIG. 13 illustrates a proposed game that has a set of targets T projected in a frame F by the projection device 4, for instance, to play with the ball 1*d* to hit a target T. Here is a difficulty to grasp where the ball 1*d* is positioned, on the basis of data such as acceleration and sounds received from the ball 1*d*. To this point, the provision of infrared detector 5 permits detection of infrared components of light radiated from the ball 1*d*, thus allowing for a facilitated identification of position of the ball 1*d*. Such the identification of position of the ball 1*d* affords to grasp whether the ball ld is positioned inside or outside the frame F, permitting a change of emission color to be developed when the ball ld resides inside the frame F, and no change of emission color to be developed when it resides outside the frame F.

Figure 14:
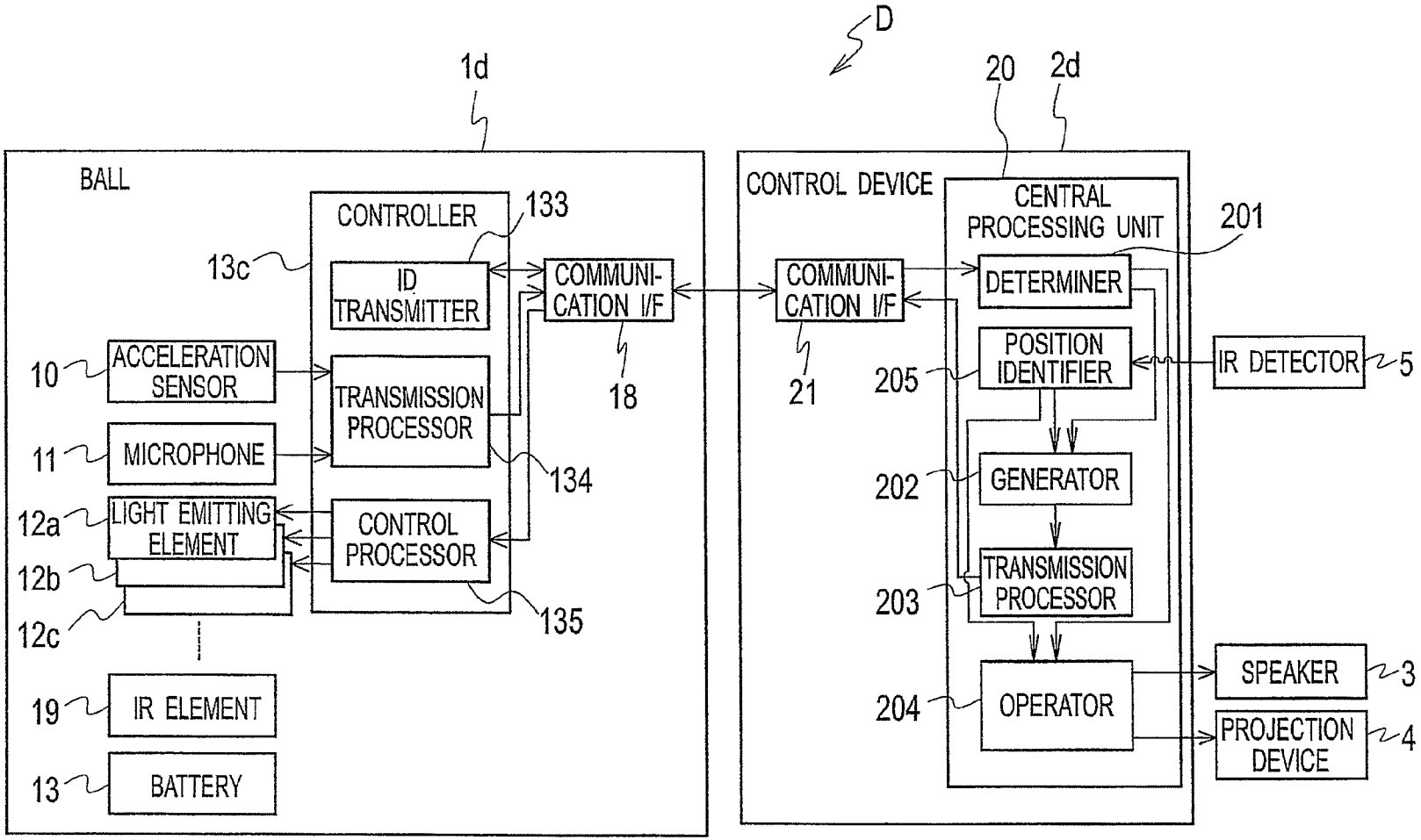
FIG. 14 is a diagram of configuration of the entertainment system shown in FIG. 12.

As shown in FIG. 14, the ball 1*d* is different from the ball 1*d* shown in FIG. 9, in that it includes an infrared element set 19. The infrared element set 19 may be an infrared LED or the like configured for emission of infrared light. For the band, the infrared element set 19 is arranged so as to emit infrared light in various direction of the ball 1*d*. Hence, the ball 1*d* may well have a set of infrared elements. For the rest of configuration, the ball 1*d* has components identical to those of the ball 1 shown in FIG. 1 or the ball 1*c* shown in FIG. 9, which are each designated at an identical reference sign to omit redundant description.

The infrared detector 5 is configured to detect infrared light emitted from the infrared element set 19, to output a detection data of infrared light to the control device 2*d*.

As shown in FIG. 14, the control device 2*d* is different from the control device 2*d* shown in FIG. 9, in that it has a central processing unit 20 including a position identifier 205.

The position identifier 205 is configured to identify a position of the ball 1*b* in accordance with a detection data input from the infrared detector 5, to output to a generator 202 and an operator 204.

The position identifier 205 maybe adapted to work when it has received from the infrared detector 5 a detection data on a coordinate where the ball 1*d* resides, for instance, to use the coordinate received from the infrared detector 5, to identify a position of the ball 1*d*. Or else, assuming a frame F divided into blocks, the position identifier 205 maybe adapted to input from the infrared detector 5 a detection data on a block where infrared light is detected, to use for identification of a position of the ball 1*d*. In the example shown in FIG. 14, the position identifier 205 is adapted to simply use infrared light detected within the frame F.

The generator 202 is adapted to generate a set of change data in accordance with combination of a result of determination at a determiner 201 and a result of identification at the position identifier 205. For instance, the generator 202 may be adapted to work to cause a change of emission color simply when the ball 1*d* resides within the frame F.

The operator 204 is adapted to operate among others the speaker 3 and the projection device 4 in accordance with combination of a result of determination at the determiner 201 and a result of identification at the position identifier 205. For instance, the operator 204 may be adapted for operation to change an effect sound, change a sound volume, or change a projected picture or the like, simply when the ball 1*d* resides within the frame F. For instance, the operator 204 may operate to cause, within a picture (frame F) the projection device 4 has projected, a change in color of a trajectory of the ball 1*d*, or a pattern developed in positions on a trajectory of the ball 1*d*. Or, there may be a motion of the ball 1*d* hitting a floor within a picture, followed by projection of ripples as images spreading from the position the ball has hit.

In the entertainment system according to the third embodiment, the control device 2*d* has similar components to the control device 2*c* shown in FIG. 9, which are each designated at an identical reference sign to omit redundant description.

It is noted that the speaker 3 and the projection device 4 have similar configurations to those described with reference to FIG. 9, and their redundant description is omitted.

Figure 15:
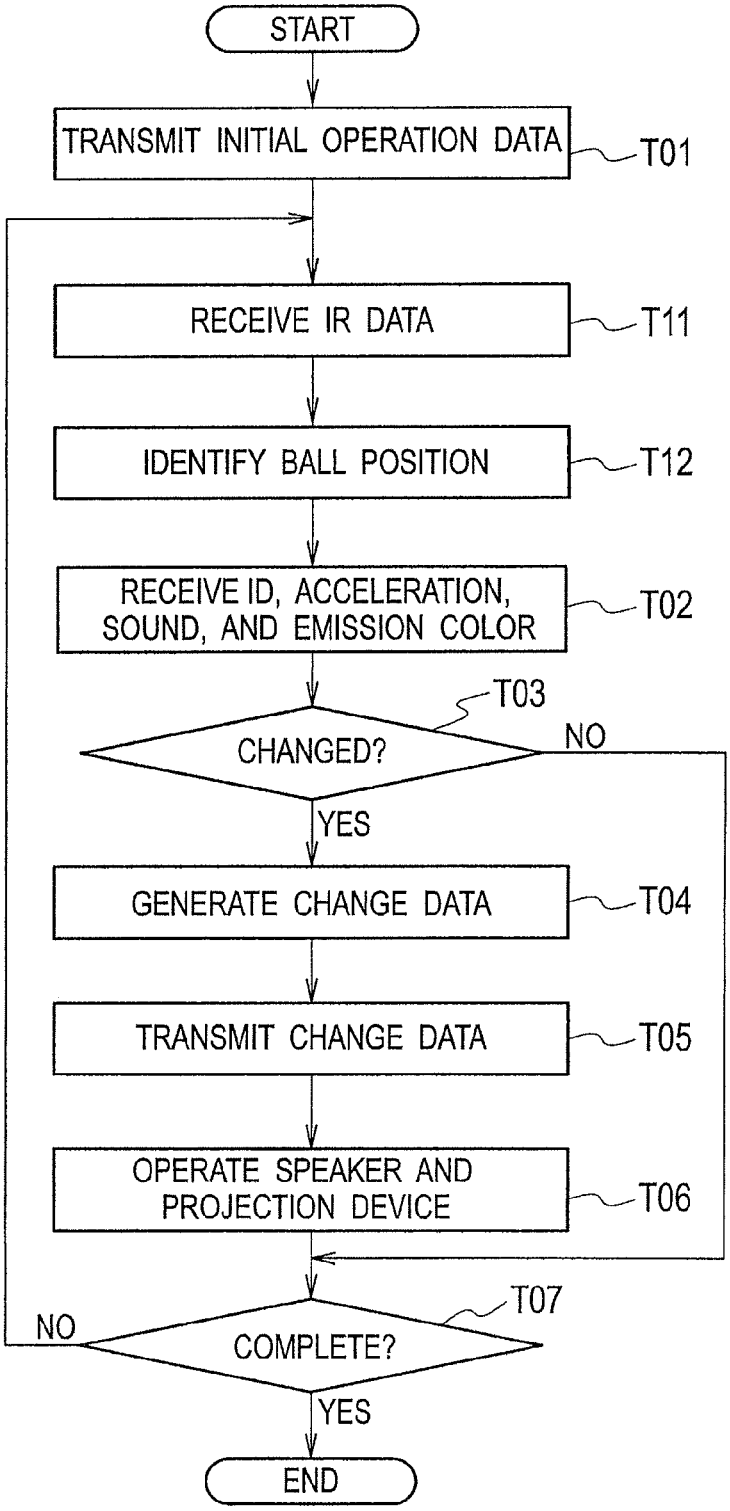
FIG. 15 is a flowchart of an example of process executed in a control device shown in FIG. 14.

Description is now made of a flow in a processing at the control device 2*d*, with reference to a flowchart shown in FIG. 15. The flowchart shown in FIG. 15 includes such processes as identical to processes in the flowchart shown in FIG. 11, which are each designated at an identical reference sign to omit redundant description.

The control device 2*d* receives infrared data transmitted from the infrared detector 5 (T11). The position identifier 205 works in accordance with received infrared data, to identify a position of the band, to output to the generator 202 and a transmission processor 203 (T12).

At a step T04 of generating change data, the generator 202 works to generate change data in accordance with combination of a position of the ball 1*d* identified at a step T12 and a result of determination at a step T03.

Further, at a step T06 of operating the speaker 3 and the projection device 4, the operator 204 works to operate in accordance with combination of a position of the ball Id identified at the step T12 and a result of determination at the step T03.

According to the third embodiment of the present invention as described, there is an entertainment system D including a control device 2*d* configured to work in accordance with a state (motion or position) of a ball 1*d*, to control emission of light at a light emitting element set 12, while controlling among others sounds output from a speaker 3 and images projected by a projection device 4. Accordingly, there is a field or space rendered with among others images projected thereto and sounds output therefrom in accordance with a motion of the ball 1*d*, allowing for an enhanced degree of satisfaction of user of the ball 1*d*.

It is noted that in the above-noted example also, the ball 1*d* may be configured with among others a light reflection sensor set 15 and/or a gyro sensor 16, as such the configuration may be implemented with one or more components out of a microphone 10, an acceleration sensor 15, a light reflection sensor set 16, and a gyro sensor 17.

Further, for instance, there may be a configuration with no provision of speaker 3, or with a speaker incorporated in the ball 1*d*, substituting for the speaker 3, allowing for use of a speaker in the ball 1*d*.

Besides above, there may be concomitant use of an infrared camera adapted for recognition of both ball 1*d* and player, to effect reflection of information on among others a position and a motion of user at the control device 1*d*, permitting operations for control to output light, sound, picture or the like. This can be done without complex rendering, affording to implement a new sport, as well. It also is possible to display a motion of the ball 1*d* on an electric scoreboard or the like, giving an explanation to audience.

<First Modification>

In the example shown in FIG. 12, there is a single infrared detector 5 disposed above the frame F, affording to define a position of the ball 1*b* simply as information on a plane (two-dimensional information in x and y directions). To this point, FIG. 16 shows an example including a combination of two infrared detectors being an infrared detector 5*a* for detecting a position in x and y directions and an infrared detector 5*b* for detecting a position in y and z directions, affording to define three-dimensional information in x, y, and z directions. That is, FIG. 16 illustrates an entertainment system according to a modification of the third embodiment, which is provided with a set of infrared detectors 5*a* and 5*b*.

For balls 1*d* put on floor, there may be a process implemented at a central processing unit 20 to identify which one of ID's received in advance from the balls 1*d* by radio communications corresponds to a ball 1*d* detected by infrared detectors 5*a* and 5*b*. For any individual ball 1*d*, if its motion is defined, this permits among others an output of sound and/or projection of picture or the like to be rendered in accordance with the motion of ball 1*d*.

Such being the case, enabled identification of a three-dimensional position of ball 1*d* would provide a wider application range of ball 1*d*. For instance, there may be basket goals provided with projection devices 4 to project pictures thereon, affording to provide audience of basket ball games with different degrees of satisfaction relative to watching ordinary games.

<Second Modification>

In the example shown in FIG. 14, the ball 1*d* has a light emitting element set 12 as an outputter for outputting a signal corresponding to a state of the ball, while the ball 1*d* may not be provided with the light emitting element set 12 as an outputter. That is, the ball 1*d* can do well with at least one of acceleration sensor 10 and microphone 12 for outputting a signal relating to a state of the ball 1*d*, or one of light reflection sensor set 15 and gyro sensor 16 described with reference to FIG. 5, together with a communication I/F 18 for transmitting a signal to the control device 2*d*.

In this case, the ball 1*d* works to simply output a signal relating to a state of the ball 1*d*. On the other hand, the control device 2*d*, receiving a signal relating to a state of ball such as a level of acceleration or a level of sound transmitted from the ball 1*d*, does work with a received signal to control among others the speaker 3 and the projection device 4, to output among others a sound and a picture. This affords to entertain audience and/or users of the ball.

Figure 17:
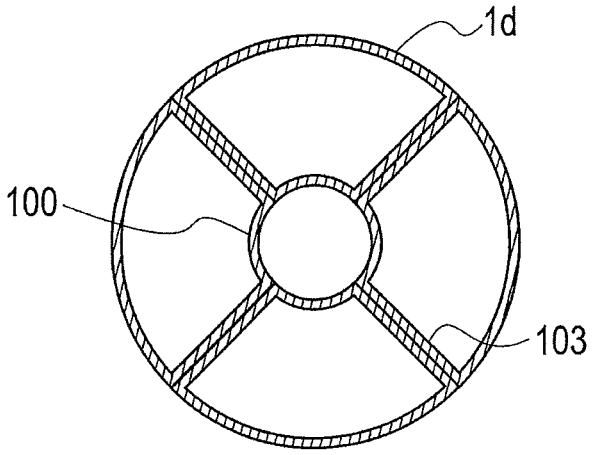
FIG. 17 is an explanatory schematic diagram of a ball in an entertainment system according to a second modification of the third embodiment of the present invention.

It is noted that the ball 1*d* may have a configuration besides or else than those described with reference to FIG. 2 and FIG. 3, with a layer made of among others metal or air inclusive, as necessary to absorb an impact. For instance, as shown in FIG. 17, there may be a ball 1*d* configured for a bounding performance to be enhanced, with a plurality of rubber tubes 103 filled with air and symmetrically arranged in positions to support a substrate 100. The number of rubber tubes 103 supporting the substrate 100 is not limited, and may well be any to make a stable support of the substrate 100. In particular, for the ball 1*d* according to the third modification of the third embodiment, which employs no light emitting element set 12 for emission of light, there is no need to take transmission of light into consideration, thus permitting use of a variety of configurations.

REFERENCE SIGNS LIST

1, 1*a* to 1*d* . . . ball
10 . . . acceleration sensor
11 . . . microphone
12 . . . light emitting element set
13, 13*c* . . . controller
14 . . . battery
15 . . . communication I/F
16 . . . infrared element set
100 . . . substrate
101 . . . intermediate layer
102 . . . outer layer
2*c*, 2*d* . . . control device
20 . . . central processing unit
21 . . . communication I/F
3 . . . speaker
4 . . . projection device
5 . . . infrared detector

The invention claimed is:

1. A ball including an outputter for producing at least one of a visual or sound output, the ball, comprising:

a light reflection sensor internal of the ball, configured to detect a level of reflection of light that is emitted from a light emitter in the ball and reflected from around the ball;

a determiner configured to work in accordance with the level of reflection of light through the light reflection sensor, to determine a state of the ball;

a control processor configured to work in accordance with a result of determination at the determiner, to generate a signal to output through the outputter to produce at least one of a visual or sound display;

a battery configured to use for operation of the light reflection sensor, the determiner, and the control processor and a layer configured to be made transparent or translucent and cover the light reflection sensor, the determiner, the control processor, and a battery to serve as a ball.

2. The ball according to claim 1, further comprising at least one of a microphone configured for acquisition of sound from inside the ball, an acceleration sensor configured to detect a level of acceleration developed with a motion of the ball, or a gyro sensor configured for acquisition of a level of angular speed developed with a motion of the ball, wherein the determiner is configured to work further in accordance with at least one of the sound, the level of acceleration or the level of angular speed, to determine a state of the ball.

3. The ball according to claim 1, wherein the outputter comprises a set of light emitting elements disposed internally of the ball and configured for emission of light, or a speaker configured to output sounds, and the control processor is configured to work in accordance with a result of determination at the determiner, to cause a change in at least one of color, luminance, and blinking rate of light emitted from the set of light emitting elements, or to work in accordance with a result of determination at the determiner, to determine a pattern and a sound volume of sounds to be output from the speaker, and cause to output sounds as determined.

4. The ball of claim 1, further including a light emitter disposed internally in the ball.

5. An entertainment system including a ball, an output device for producing at least one of a visual or sound output in accordance with a state of the ball, and a control device adapted for control of signal output at the output device, wherein the ball comprises:

a light reflection sensor internal of the ball, configured to detect a level of reflection of light that is emitted from a light emitter in the ball and reflected from around the ball;

a first communicator configured to transmit the level of reflection of light detected at the light reflection sensor to the control device;

a second communicator configured to receive the level of reflection of light, and work in accordance with the level of reflection of light, to transmit to the output device a control signal to control the signal output;

a determiner configured to work in accordance with the level of reflection of light received at the second communicator, to determine a state of the ball;

a generator configured to work in accordance with a result of determination at the determiner, to generate a signal outputted to the second communicator for control of the output device to produce at least one of a visual or sound display;

a battery configured to use for operation of the light reflection sensor, the first communicator, the second communicator, the determiner, and the generator; and a layer configured to be made transparent or translucent and cover the light reflection sensor, the first communicator, the second communicator, the determiner, the generator, and the battery to serve as a ball.

6. The entertainment system according to claim 5, wherein the ball further comprises at least one of a microphone configured for acquisition of sound from inside the ball, an acceleration sensor configured to detect a level of acceleration developed with a motion of the ball or a gyro sensor configured to detect a level of angular speed developed with a motion of the ball, the first communicator of the ball is configured to transmit at least one of the sound, the level of acceleration or the level of angular speed to the control device in addition to the level of reflection, the second communicator of the control device is configured to receive at least one of the sound, the level of acceleration or the level of angular speed from the ball in addition to the level of reflection, and the determiner of the control device is configured to work further in accordance with at least one of the sound, the level of acceleration or the level of angular speed to determine the state of the ball.

7. The entertainment system according to claim 5, wherein the output device is external of the ball and comprises a set of light emitting elements configured for emission of light or a speaker configured to output sounds, and the generator of the control device is configured to generate a signal to cause a change in at least one of color, luminance, and blinking rate of light emitted from the set of light emitting elements based on the determination result of the determiner, or to generate a signal containing a pattern and a sound volume of sounds to be output from the speaker based on the determination result of the determiner.

8. The entertainment system according to claim 5, wherein the output device includes both a first output device installed on the ball and a second output device installed external of the ball.

9. The entertainment system according to claim 5, further comprising an infrared detector external of the ball and configured to detect infrared light to transmit a result of detection to the control device, wherein the ball further comprises an infrared element set configured to output infrared light for detection by said infrared detector, and the generator of the control device is configured to use a result of detection of infrared light received from the infrared detector to generate a control signal indicating the position of the ball.

10. The entertainment system according to claim 5, wherein the output device is a projection device disposed externally of the ball and configured to project image or light.

11. An entertainment system including a ball, a projection device adapted to output a signal in accordance with a state of the ball, and a control device adapted for control of signal output at the projection device, wherein the ball comprises:

a sensor configured for acquisition of information regarding a state of the ball, the sensor including at least one of a light reflection sensor, a microphone, an acceleration sensor or a gyro sensor;

a first communicator configured to transmit the information acquired by the sensor to the control device;

a battery configured to use for operation of the sensor and the first communicator; and a layer configured to cover the sensor, the first communicator, and the battery to serve as a ball; wherein the projection device is installed externally of the ball and comprises an imaging and lighting device configured to project image or light in response to a determined sate of the ball; and wherein the control device comprises:

a second communicator configured to receive the information acquired by the sensor and transmitted from the ball, and work in accordance with the received information to transmit to the projection device a control signal to control the projected image or light;

a determiner configured to work in accordance with the information acquired by the sensor and received at the second communicator, to determine a state of the ball; and a generator configured to work in accordance with a result of determination at the determiner, to generate a control signal for control of the projection device, and to output the control signal to the second communicator.

12. The entertainment system according to claim 11, wherein when the sensor includes a light reflection sensor, the ball includes a light emitter disposed internally of the ball and the light reflection sensor is configured for acquisition of a level of reflection of light that is emitted from the light emitter in the ball and reflected from around the ball, wherein when the sensor includes a microphone, the microphone is configured for acquisition of sound from inside the ball, wherein when the sensor includes an acceleration sensor, the acceleration sensor is configured for acquisition of a level of acceleration developed with a motion of the ball and wherein when the sensor includes a gyro sensor, the gyro sensor is configured for acquisition of a level of angular speed developed with a motion of the ball.

13. The entertainment system according to claim 11, wherein the imaging and lighting device projects an image or emits light on the prescribed area where the ball is used.

14. The entertainment system according to claim 11, wherein the projection device further comprises at least one of a set of light emitting elements configured for emission of light, or a speaker configured to output sounds installed external of the ball and the generator of the control device is configured to generate a signal to cause a change in at least one of color, luminance, and blinking rate of light emitted from the set of light emitting elements based on the determination result of the determiner, or to generate a control signal to operate the speaker based on the determination result of the determiner.

15. The entertainment system according to claim 11, further comprising an infrared detector external of the ball and configured to detect infrared light to transmit a result of detection to the control device, wherein the ball further comprises an infrared element set configured to output infrared light for detection by said infrared detector, and the generator of the control device is configured to use a result of detection of infrared light received from the infrared detector to generate a control signal indicating the position of the ball.

16. An entertainment system including a ball, an output device for producing at least one of visual or sound output in accordance with a state of the ball, and a control device adapted for control of signal output at the output device, wherein the ball comprises:

a light reflection sensor internal of the ball configured to detect a level of reflection of light that is emitted from a light emitter in the ball and reflected from around the ball;

a first communicator including a communication interface configured for wireless transmission to transmit a signal representing the level of reflection of light detected at the light reflection sensor to the control device;

a battery configured to use for operation of the light reflection sensor and the first communicator and a layer configured to be made transparent or translucent and cover the light reflection sensor, the first communicator, and the battery to serve as a ball;

the control device comprises:

a second communicator including a communication interface configured for wireless communication to receive the signal representing the level of reflection of light, and work in accordance with the level of light reflection of light, to wirelessly transmit to the output device a control signal to control the signal output at the output device;

a determiner configured to work in accordance with the signal representing the level of reflection of light received at the second communicator to determine a state of the ball; and a generator configured to work in accordance with a result of determination at the determiner, to generate a signal outputted to the second communicator for control of the output device to produce at least one of a visual or sound display.

* * * * *